US009579772B2

(12) United States Patent
Lu et al.

(10) Patent No.: US 9,579,772 B2
(45) Date of Patent: Feb. 28, 2017

(54) APPLICATION OF THE NEWLY DEVELOPED TECHNOLOGY IN STAINLESS STEEL FOR BIOMEDICAL IMPLANT

(71) Applicant: Nano and Advanced Materials Institute Limited, Hong Kong (HK)

(72) Inventors: Jian Lu, Hong Kong (HK); Huaiyu Wang, Hong Kong (HK)

(73) Assignee: NANO AND ADVANCED MATERIALS INSTITUTE LIMITED, Hong Kong (HK)

( * ) Notice: Subject to any disclaimer, the term of this patent is extended or adjusted under 35 U.S.C. 154(b) by 12 days.

(21) Appl. No.: 14/534,177

(22) Filed: Jan. 5, 2015

(65) Prior Publication Data

US 2016/0031063 A1 Feb. 4, 2016

Related U.S. Application Data

(63) Continuation-in-part of application No. 14/449,158, filed on Aug. 1, 2014.

(51) Int. Cl.

| | |
|---|---|
| ***B24C 5/00*** | (2006.01) |
| ***B24C 1/04*** | (2006.01) |
| ***B26F 3/00*** | (2006.01) |
| ***B24C 1/10*** | (2006.01) |
| *C21D 7/06* | (2006.01) |

(52) U.S. Cl.

CPC ..... *B24C 1/10* (2013.01); *B24C 1/04* (2013.01); *B24C 5/005* (2013.01); *B26F 3/004* (2013.01); *C21D 7/06* (2013.01)

(58) Field of Classification Search

CPC ... B24C 1/10; B24C 3/04; B24C 5/005; B26F 3/004; C21D 7/06; C21D 2201/03; B21D 31/06; Y10T 29/479

USPC ..... 72/53, 710; 428/687

See application file for complete search history.

(56) References Cited

U.S. PATENT DOCUMENTS

2009/0301152 A1* 12/2009 Bayer ..... B24C 5/005 72/53
2011/0146361 A1* 6/2011 Davidson ..... A61F 2/2418 72/53
2011/0252850 A1* 10/2011 Lu ..... A61F 2/30767 72/53

OTHER PUBLICATIONS

'Effects of surface mechanical attrition treatment (SMAT) on a rough surface of AISI 316L stainless steel', by B. Arifvianto and Suyitno, M. Mahardika, publically available Jan. 28, 2012.*

* cited by examiner

*Primary Examiner* — Peter DungBa Vo
*Assistant Examiner* — Joshua D Anderson
(74) *Attorney, Agent, or Firm* — Daniel R. Collopy

(57) ABSTRACT

The present invention pertains to a method of applying surface mechanical attrition treatment (SMAT) with a plurality of balls for treating surfaces of metallic alloys under a set of specific conditions in order to obtain a metal substrate with high yield strength and hardness, low cytotoxicity, high cytocompability and hemocompatibility suitable for medical implant. The plurality of balls used in the present invention comprises 316L stainless steel balls or zirconium oxide ($ZrO_2$) balls.

14 Claims, 28 Drawing Sheets

APPLICATION OF THE NEWLY DEVELOPED TECHNOLOGY IN STAINLESS STEEL FOR BIOMEDICAL IMPLANT

CROSS REFERENCE TO RELATED APPLICATION

This is a continuation-in-part application of the non-provisional patent application Ser. No. 14/449,158 filed Aug. 1, 2014, and the disclosure of which is incorporated herein by reference in its entirety.

FIELD OF THE INVENTION

The present invention relates to nanostructured lattices, and methods for fabricating said nanostuctured lattices, and more particularly relates to nanostructures lattices produced by surface mechanical attrition treatment method.

BACKGROUND

Lattices are commonly used as light-weight structures due to their inherent cavities. Examples of these structures are truss bridges, stadiums' framework roofs and telescope supporters. In the simple two-dimensional (2D) space, the common periodic lattices are constructed from the geometrical shapes of regular polygons such as equilateral triangle, square and regular hexagon. See FIG. 1 (Ashby and Gibson, 1997; Fleck el al., 2010).

Nevertheless, in some cases, the mechanical properties of the lattices such as tensile strength, hardness, or ductility are not able to fulfill the requirements in certain applications.

Stainless steel 316L is a traditional material that can be utilized for fabricating cardiovascular stents due to an excellent combination of mechanical properties, corrosion resistance and biocompatibility. However, in comparison with some other metallic biomaterials for stents (e.g. cobalt chromium alloy, Co—Cr), 316L SS is still inferior in terms of yield strength and hardness, hence the strut thickness of 316L SS stents (~150 μm) should be much thicker than that of Co—Cr stents (~90 μm) to meet the mechanical requirements. Metallic stents are foreign matters to human body, the targeted vessel could be re-narrowing after the long-term intervention due to the adverse tissue reactions such as inflammations and immunological rejections. It is demonstrated by patient outcomes that stents with thicker struts result in higher restenosis rates compared to those with thinner struts. Moreover, the thick struts of stents will compromise the flexibility, thus the track of stents through the guide catheter and through the tortuous anatomy of the coronary arteries will be more difficult. There are other problems in existing metallic stents such as potential toxic Ni release, relatively high cytotoxicity, low cytocompatibility to certain cell type (e.g. endothelial cells), and low hemocompatibility.

CN101899554A disclosed a NiTi alloy which is treated with plasma nitriding followed by surface mechanical attrition treatment (SMAT) to improve the hardness of the NiTi alloy. Although plasma nitriding treatment was shown to improve the hardness of NiTi alloy in CN101899554A, plasma nitriding will cause unwanted effects on other metallic alloys, especially stainless steel because of the high content of iron in stainless steel which becomes unstable after plasma nitriding. Plasma nitriding also increase the Ni release from those metallic alloys, which is unfavorable to the cell growth and tissue regeneration around an implantable medical device such as stent made of those metallic alloys.

Therefore, a 316L SS alloy with a higher yield strength and hardness, reduced Ni release, relatively lower cytotoxicity, higher cytocompatibility to endothelial cells, and improved hemocompatibility as an ideal biomaterial for fabricating implantable medical device is needed.

SUMMARY OF THE INVENTION

Accordingly, the main aspect of the presently claimed invention is to provide a method of applying surface mechanical attrition treatment (SMAT) under with a plurality of balls having a desirable size and weight to treat surfaces of a metal substrate for a medical implant under a set of operational conditions. These conditions include but not limited to vibrating frequency, amplitude, and treatment time. In an exemplary embodiment, the balls to be used for treating surfaces of the metal substrate can be 316L stainless steel balls or Zirconium oxide ($ZrO_2$) balls in a size of about 03.0 mm. The metal substrate to be treated by SMAT with the balls is 316L stainless steel plate (mirror polished). In another embodiment, the total weight of the balls is about 20 g for treating the metal substrate in a dimension of 100 mm×50 mm×0.9 mm. There is provided an enclosure with a chamber holding the metal substrate and the balls of the presently claimed invention to perform SMAT on the metal substrate. The chamber is also configured to hold a vibrating means on an opposite side to the metal substrate for generating a vibrating frequency of about 20,000 Hz to move the balls travelling along the chamber towards the metal substrate in order to treat the surfaces of the metal substrate. In yet another embodiment, the working amplitude of the vibrating means is about 80%. The treatment time on each side of the metal substrate is about 15 minutes; total time for treating both sides of the metal substrate is therefore about 30 minutes. The total time for treating both sides of the metal substrate can be divided into four time intervals: (i) from 0 to $1^{st}$ minute; (ii) from $1^{st}$ minute to $5^{th}$ minute; (iii) from $5^{th}$ to $29^{th}$ minute; and (iv) from $29^{th}$ minute to $30^{th}$ minute. At each time interval, the average duration per strike using the presently claimed balls to perform SMAT on each side of the metal substrate ranges from 5 seconds up to 15 seconds per strike. Plasma nitriding treatment before SMAT should be avoided in the presently claimed invention.

BRIEF DESCRIPTION OF THE DRAWINGS

Embodiments of the present invention are described in more detail hereinafter with reference to the drawings, in which.

DETAILED DESCRIPTION OF PREFERRED EMBODIMENTS

In the following description, nanostructured lattices, and the corresponding embodiments of the fabrication methods are set forth as preferred examples which have been disclosed in the prior U.S. non-provisional patent application Ser. No. 14/449,158.

The invention is the combination of lattice topologies and nano-structured materials induced by the SMAT process. On one hand, the SMAT method increases significantly the strength of metallic materials. On the other hand, lattice topologies possess variety in designing the mass and geometries of these structures. As combined, the SMAT-lattice structures are much stronger, and can be of various geometrical sizes and masses.

The invention concerns with the design and manufacturing of lattice architectures from the nano-structured materials produced by SMAT process. The methodology of generating solid nano-structured materials by SMAT process is outlined in the prior art, U.S. Pat. No. 7,691,211. This method has been proved to increase significantly the strength of metallic materials such as stainless steel sheets, see Chan et al., (2010) and Chen et al., (2011).

Figure 1:
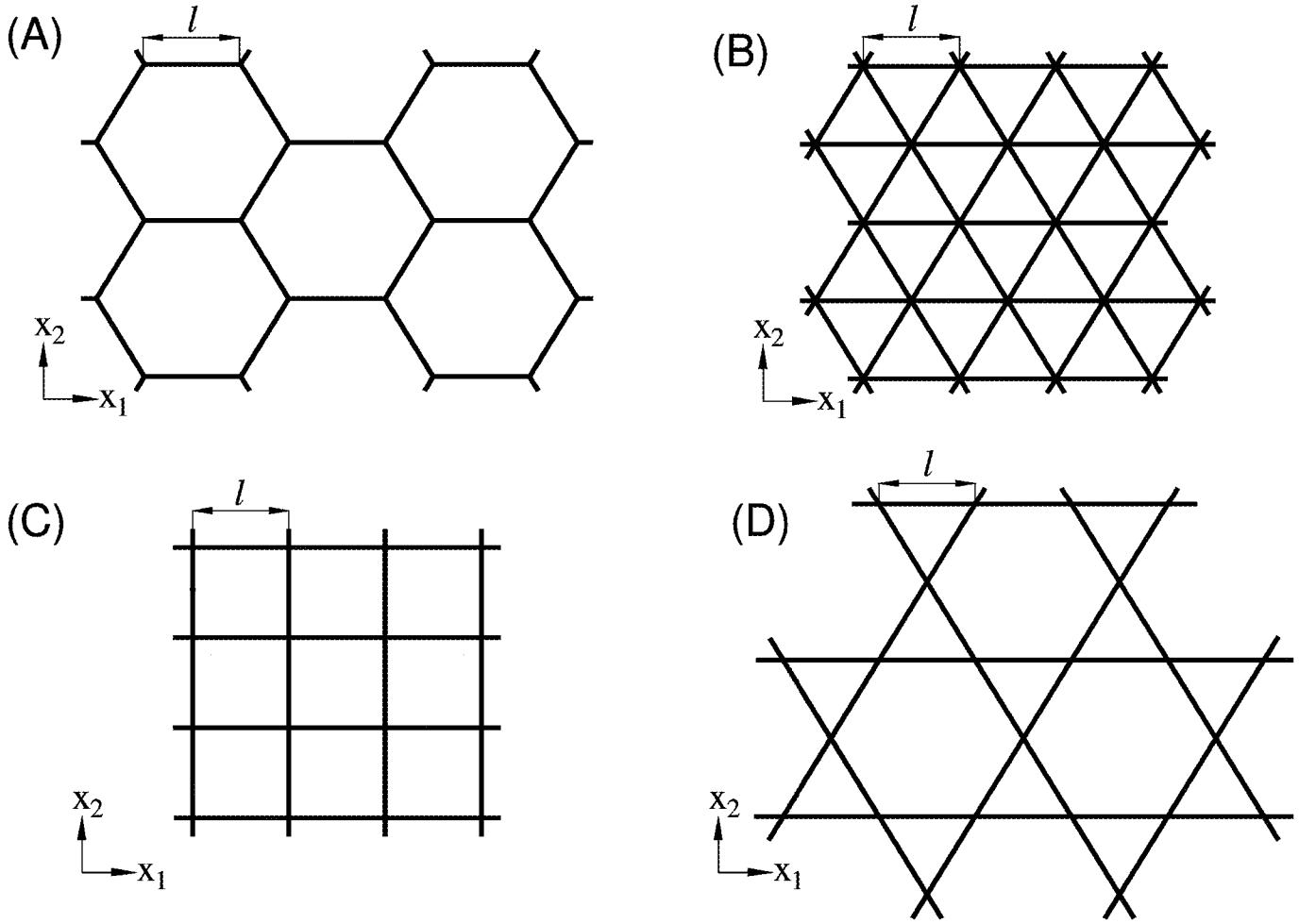
FIG. 1 (Prior Art)
FIG. 1 shows different shapes of lattices in a prior art.
Figure 2:
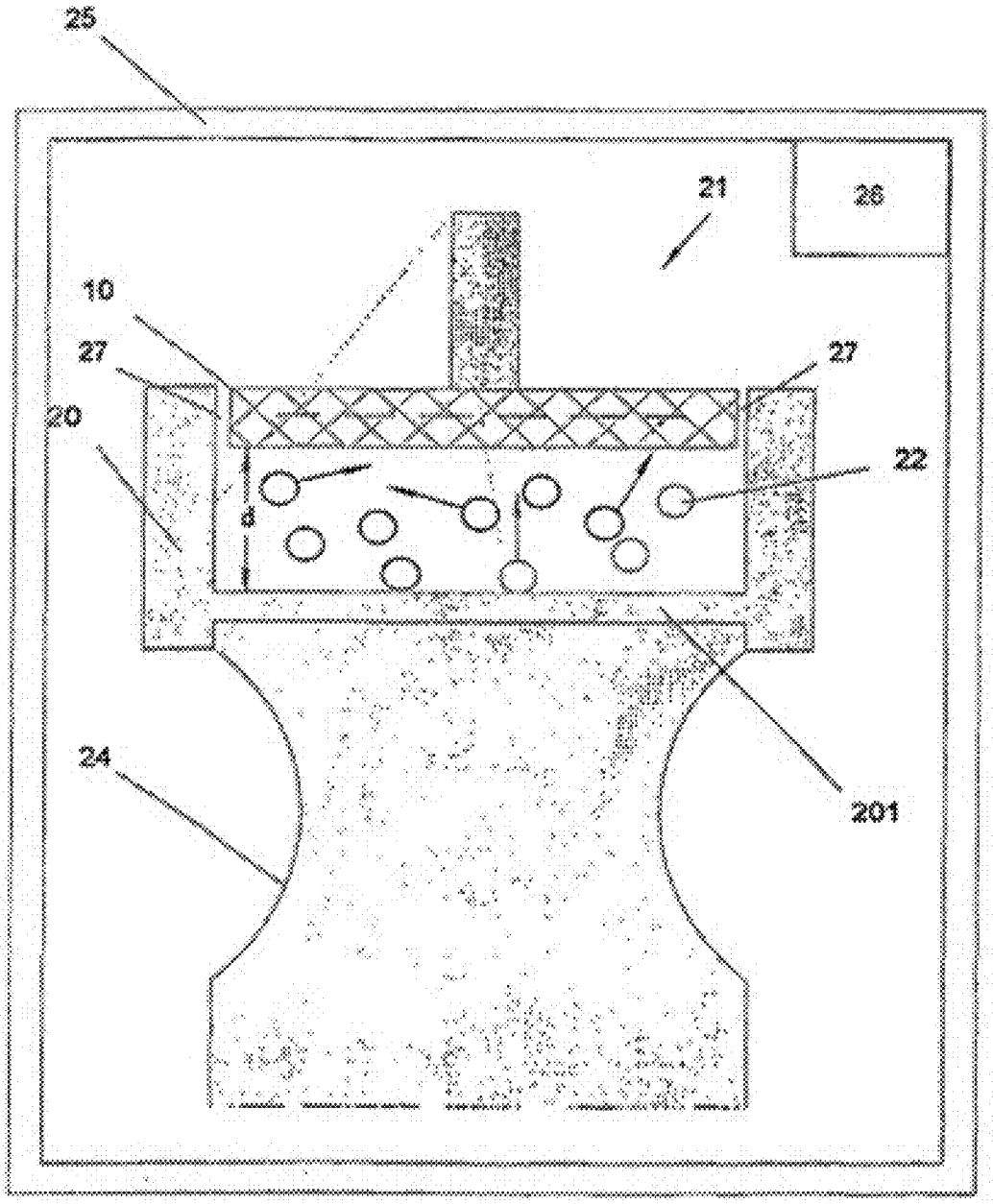
FIG. 2 (Prior Art)
FIG. 2 shows a schematic diagram of a device for generating nanostructure in a SMAT process in a prior art.

Nano-structured materials have been effectively generated by the surface mechanical attrition treatment method, see Lu and Lu (1999 & 2004) and U.S. Pat. No. 7,691,211. In the SMAT process, a number of spherical projectiles are actuated by a vibration generator to impact the material surface at various angles, as schematically shown in FIG. 2. Thus, the coarse grain sizes at this surface are reduced to form a nano-structured layer with grain size of several tens of nanometers. As a result, the macroscopic mechanical properties of the material such as strength and hardness are significantly increased (Chan et al., 2010; Chen et al., 2011).

FIG. 2 represents a diagram of a SMAT device for generating nanostructures using ultrasound in the prior art, U.S. Pat. No. 7,691,211, which can be used to implement the invention. In this embodiment of the prior art, the SMAT device comprises an acoustic isolation chamber 25. The sonotrode 24 is joined to a bowl 20 whose top opening is blocked by a device 21 for placing the piece 10 to be treated under stress. The device 21 is mounted relative to the bowl 20 on means that make it possible to adjust the distance between the surface exposed to the bombardment and the bottom of the bowl 201, which constitutes the emission surface of the balls 22. A space 27 can be provided between the piece to be treated or its support and the bowl 20. The principle of setting the balls in motion using ultrasound is to set the balls 22 in motion by means of an ultrasonic generator 24 operating at a given frequency, which communicates a movement of given amplitude and speed to the bowl 20. The amplitude of the movement of the sonotrode could be chosen so as to be from a few microns to a few hundred microns. The balls 22 draw their energy from the movement of the bowl and hit the surface of the piece 10 a large number of times, at variable and multiple incident angles, creating with each impact a plastic deformation of the grains constituted by an agglomerate of molecules of the material or the alloy, in any direction. A ball that loses its energy in contact with the piece bounces off the walls of the bowl so as to acquire a new speed in a direction which, seen from the piece, seems random but is determined by physical laws. Diffusing or vaporizing means 26 are disposed in the sealed acoustic chamber 25, making it possible to perform one or more of the chemical or thermochemical treatments described below, possibly associated with means for heating the chamber or the piece.

In this invention, holes of regular polygonal shapes (triangle, square or hexagon) are embedded inside the solid nano-structured materials in uniform and periodic patterns in order to reduce the overall mass and to create light-weight structures. There are four types of the lattice designs as exhibited in FIG. 3. These are: hexagonal (FIG. 3A), triangulated (FIG. 3B), square (FIG. 3C), and Kagome (FIG. 3D) lattices, respectively.

Figure 3A:
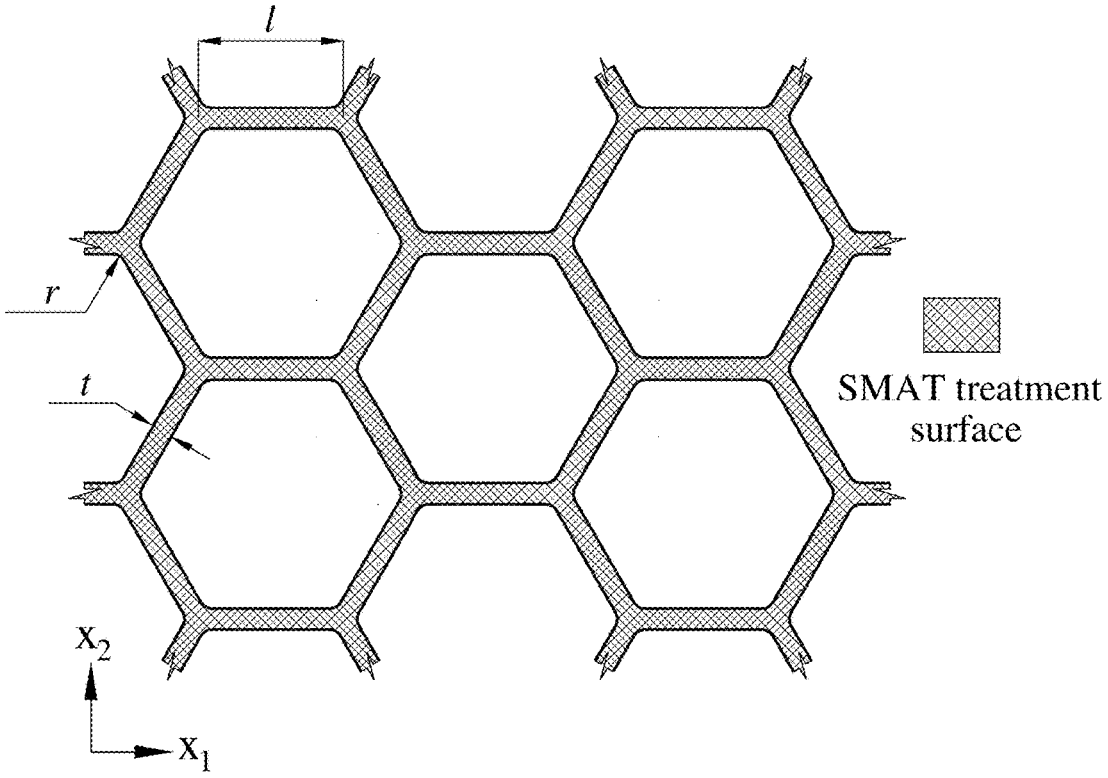
FIG. 3A-D shows four types of nanostructured lattices according to various embodiments of the presently claimed invention.

FIG. 3A presents the design of the hexagonal honeycomb lattice. This lattice only has identical holes of regular hexagonal shapes. These holes are located in a periodic pattern such that the lattice can uniformly extended in the two principal $x_1$- and $x_2$-axes of the 2D space.

Figure 3B:
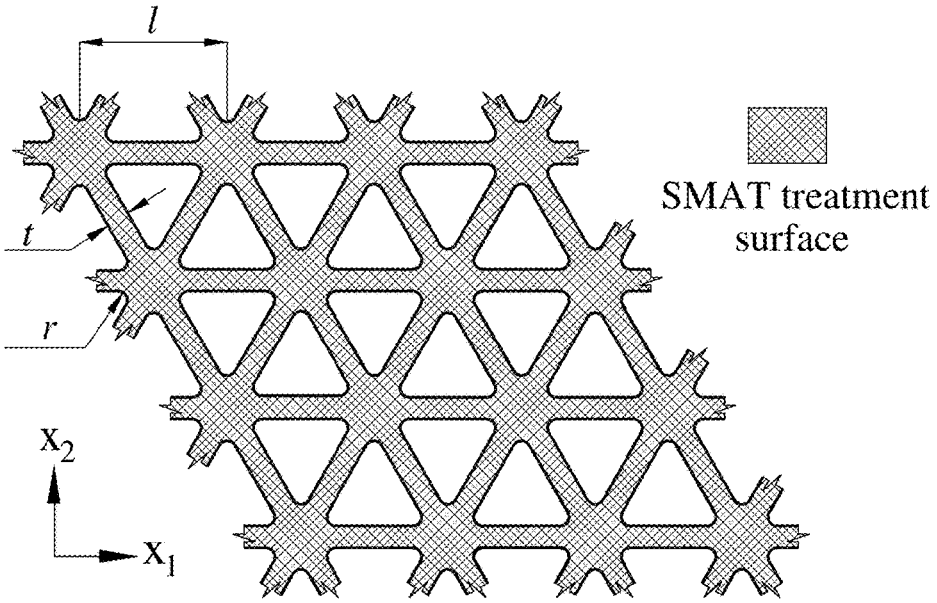

FIG. 3B presents the design of the triangulated lattice. This lattice only has identical holes of equilateral triangular shapes. These holes are also arranged in a periodic pattern along the two principal $x_1$- and $x_2$-axes of the planar space.

Figure 3C:
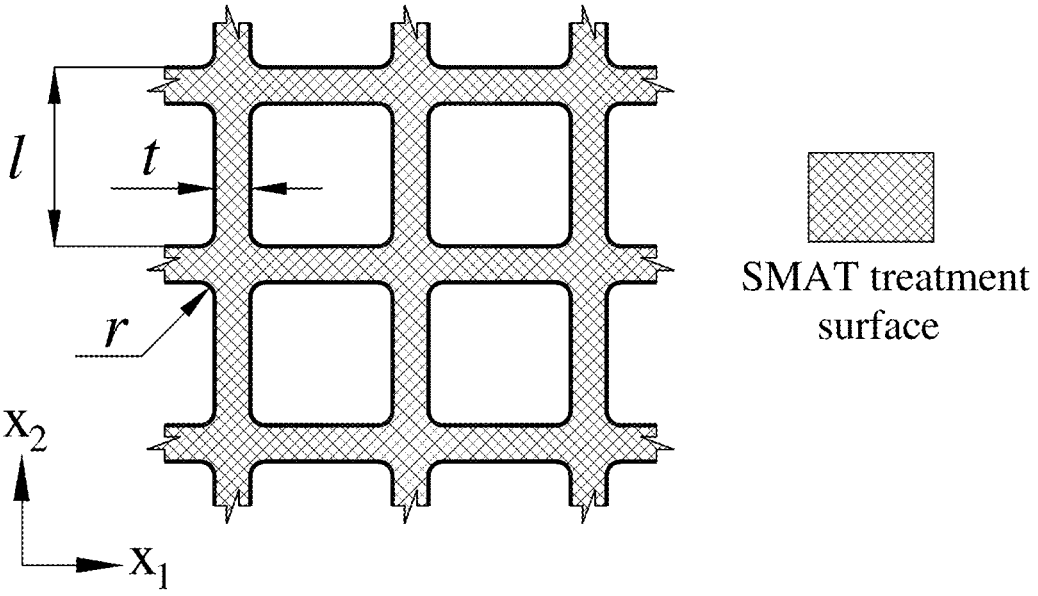

FIG. 3C presents the design of the square lattice. This lattice only has identical holes of square shapes. These holes are periodically located along the two principal $x_1$- and $x_2$-axes of the planar space.

Figure 3D:
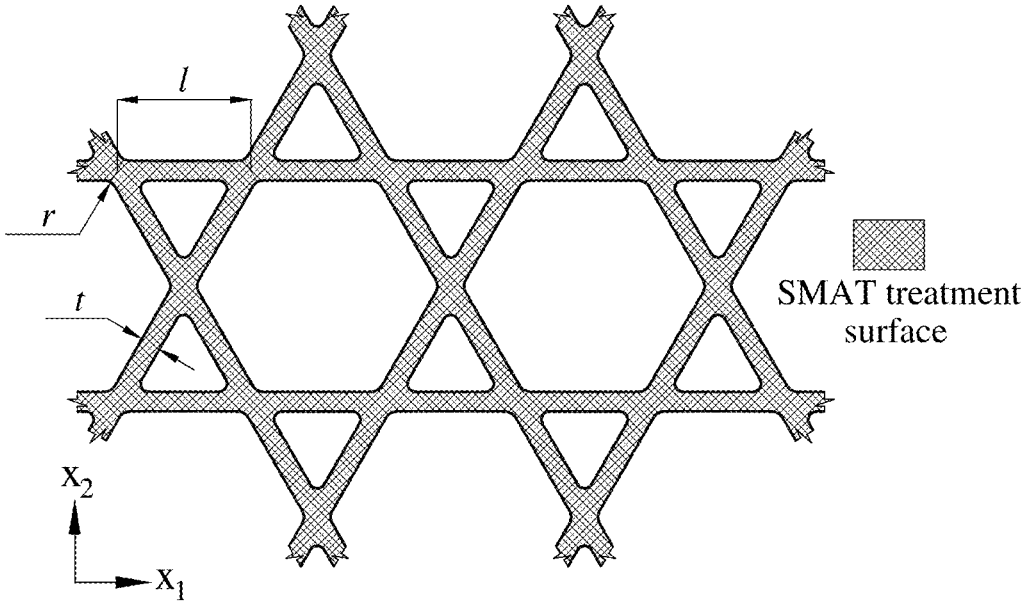

FIG. 3D presents the design of the Kagome lattice. This lattice has identical holes of regular hexagonal and equilateral triangular shapes. These holes are arranged in a periodic pattern such that the lattice can uniformly extended in the two principal $x_1$- and $x_2$-axes of the 2D space.

For each type of the lattice, the remaining solid framework of bars is characterized by three geometrical parameters (t, l, r): l is the designed central-line length of each bar member in the lattice; t is the designed thickness of each bar member of the lattice; r is the designed radius of the blunting round-off at each nodal corner of the lattice. This round-off is designed to reduce the stress concentration at the nodal positions of the lattice.

The mass of each lattice depends mainly upon t and l, and can be varied by changing the values of these two parameters. For example, the lattice can be considered as being thin (low mass) if the ratio $l/t \geq 30$, while it can be thick (high mass) if $4 \leq l/t \leq 10$. The designed ratio of t/r is in the range of 1 to 2.

According to an embodiment of the presently claimed invention, the manufacturing method of nano-structured lattices is shown as follows. Firstly, the initial solid material is treated by SMAT process to produce nano-structured material following the prior art, U.S. Pat. No. 7,691,211. Secondly, the type of the lattice is chosen, and the values of the three parameters (l, t, r) are designed in order to determine the dimensions of the holes, which will be removed from the solid SMAT material. The three designed values of (l, t, r) are also used to construct the drawing of the lattice for programming in the CNC water-cutting machine. Finally, the designed holes are wire-cut off from the solid nano-structured material by the CNC machine, and the nano-structured lattice is consequently achieved.

In the invention, nano-structured materials produced by surface mechanical attrition treatment method are particularly explored for two periodic lattice topologies: square and Kagome. Selected SMAT strategies are applied to bar members in the unit cell of each topology considered. The maximum axial stress in these bars is calculated as a function of the macroscopic in-plane principal stresses. A simple yield criterion is used to determine the elastic limit of the lattice with each SMAT strategy, and the relative merits of the competing strategies are discussed in terms of the reinforced yield strength and the SMAT efficiency. Experiments of selected SMAT strategies on both square and Kagome lattices made from stainless steel sheets are performed to assess the analytical predictions for the loading case of uni-axial tension.

Experiments on the uni-axial tension of square and Kagome lattices treated with SMAT are shown as follows.

Experimental tests have been performed to explore the strengthening effect of SMAT method upon the two lattices considered. The specimens of square and Kagome topologies arranged in selected directions were manufactured and treated with SMAT. These lattice samples were subjected to uni-axial tension test in turn, and the SMAT effect was assessed for each lattice topology.

Square lattices: 0/90° versus ±45°, are tested and studied as follows.

A series of SMAT strategies applied to each unit cell of the square lattice is introduced as follows.

(i) Strategy N: no SMAT; this is for comparison purposes.

Figure 4:
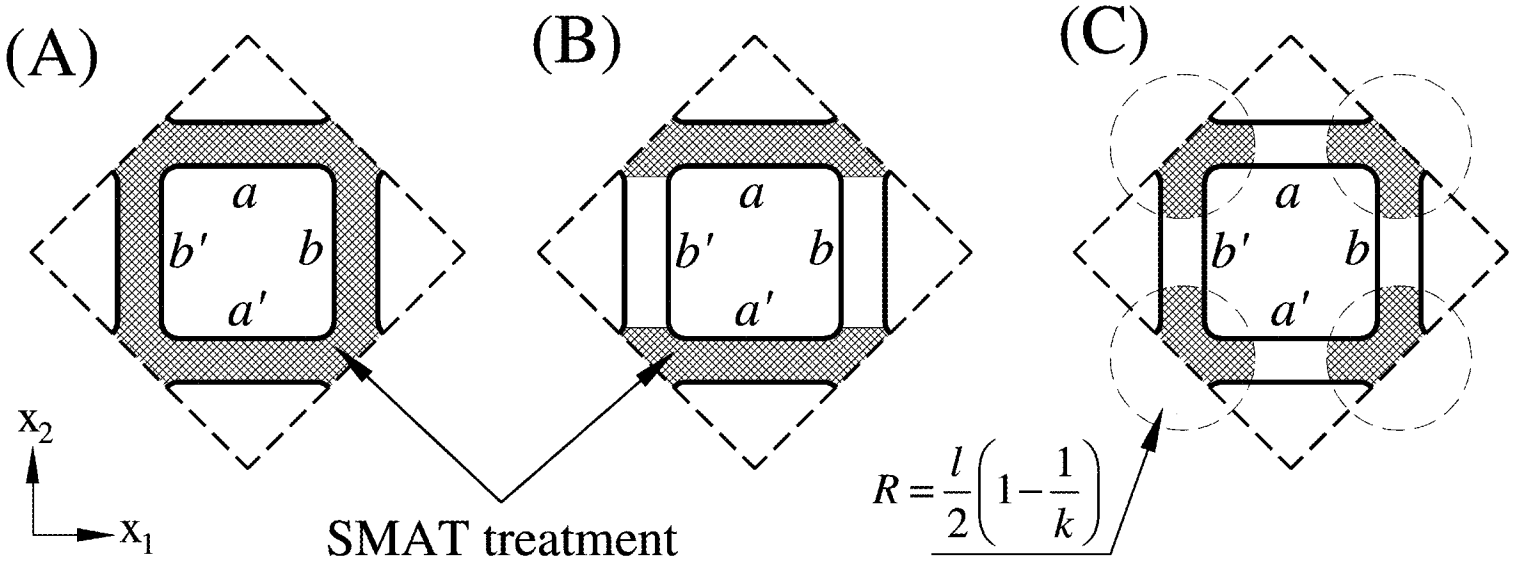
FIG. 4 shows SMAT for each unit cell of the square lattice with (A) strategy AI, (B) strategy AII, and (C) strategy AIII according to an embodiment of the presently claimed invention.

(ii) Strategy AI: all bar members in the lattice are completely treated with SMAT, see FIG. 4A. This strategy is aimed for any in-plane loadings.

(iii) Strategy AII: only two horizontal bars a and a' are SMAT-treated, see FIG. 4B. The strategy is for the loading case of uni-axial tension along the $x_1$-axis of the square lattice. In this case, the two bars a and a' are directly subjected to the applied load while the other two bars b and b' carry negligible forces.

(iv) Strategy AIII: the SMAT is applied to the end portions of the bars within a circle of radius $R=(1-1/k)l/2$ around each node, see FIG. 4C. This is for the case of uni-axial tension in the ±45° directions of the square lattice. Under this load, all the bars undergo bending and the maximum stresses occur at the vicinity of the bar ends. Thus, applying SMAT to these areas can be most efficient.

Figure 5:
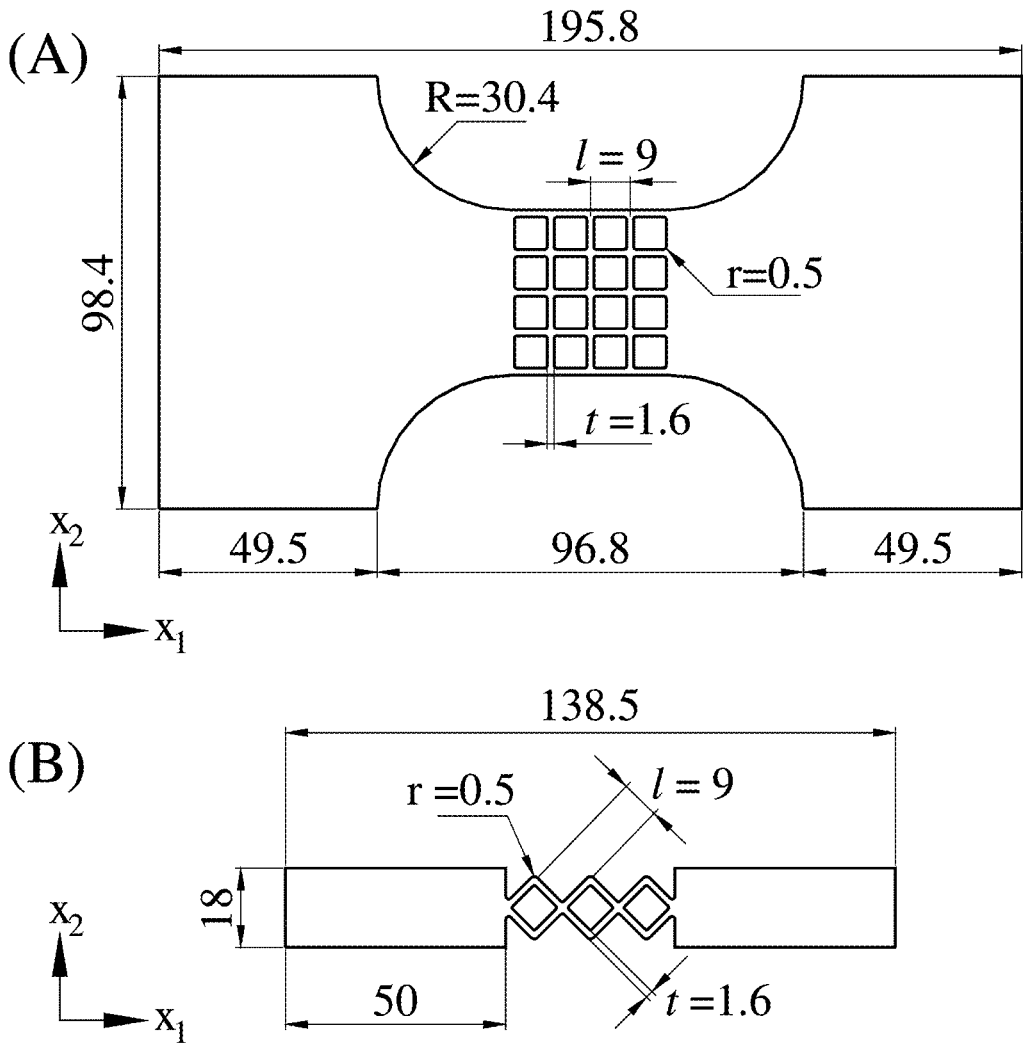
FIG. 5 shows geometry of the experimental specimens with (A) a 0/90° square lattice, and (B) a ±45° square lattice respectively according to an embodiment of the presently claimed invention.

Geometries of tensile dog-bone specimens are shown in FIG. 5A for the 0/90° square lattice and in FIG. 5B for the ±45° square lattice, respectively. Each bar member in the square lattice is of length l=9 mm and width t=1.6 mm, giving the relative density, $\bar{\rho}=2t/l=0.35$.

Figure 6:
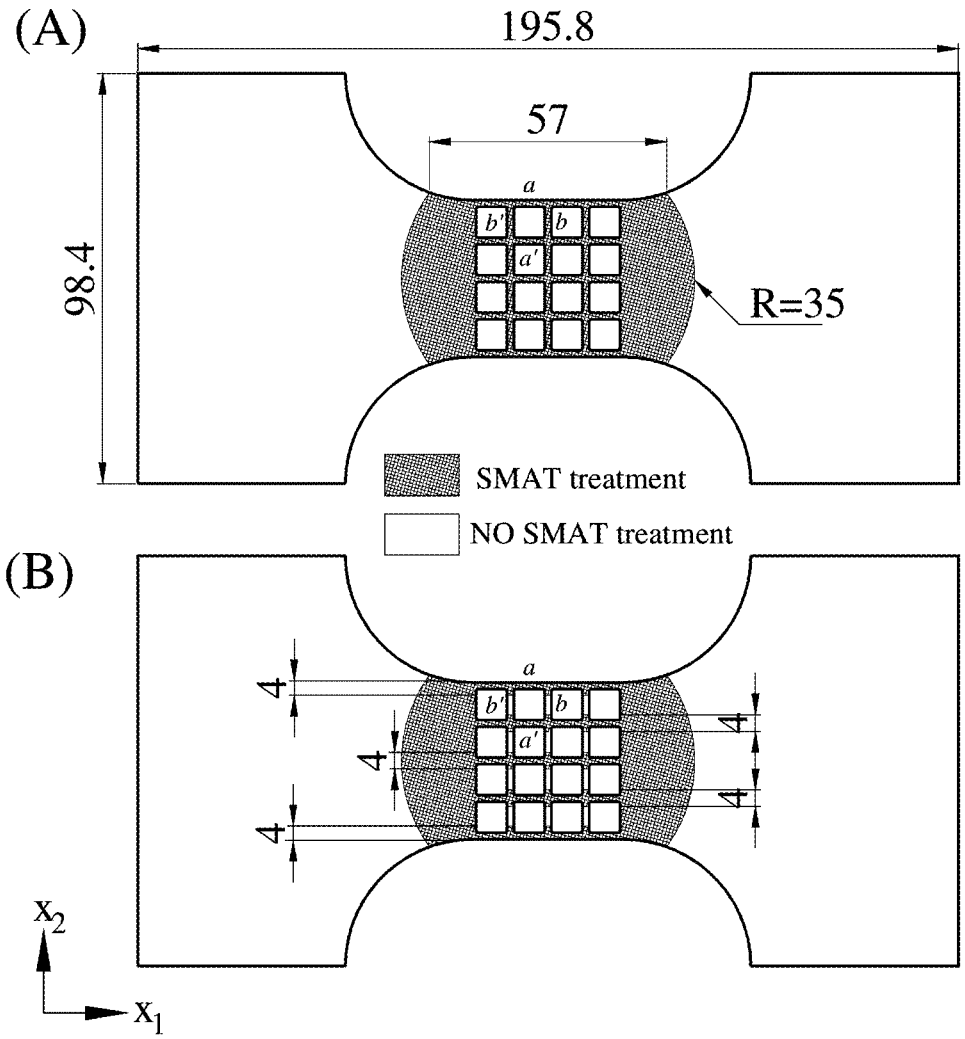
FIG. 6 shows two 0/90° square lattices with (A) fully SMAT-strategy AI, and (B) partly SMAT-strategy AII respectively, and two ±45° square lattices with (C) fully SMAT-strategy AI, and (D) partly SMAT-strategy AIII respectively according to an embodiment of the presently claimed invention.
Figure 6:
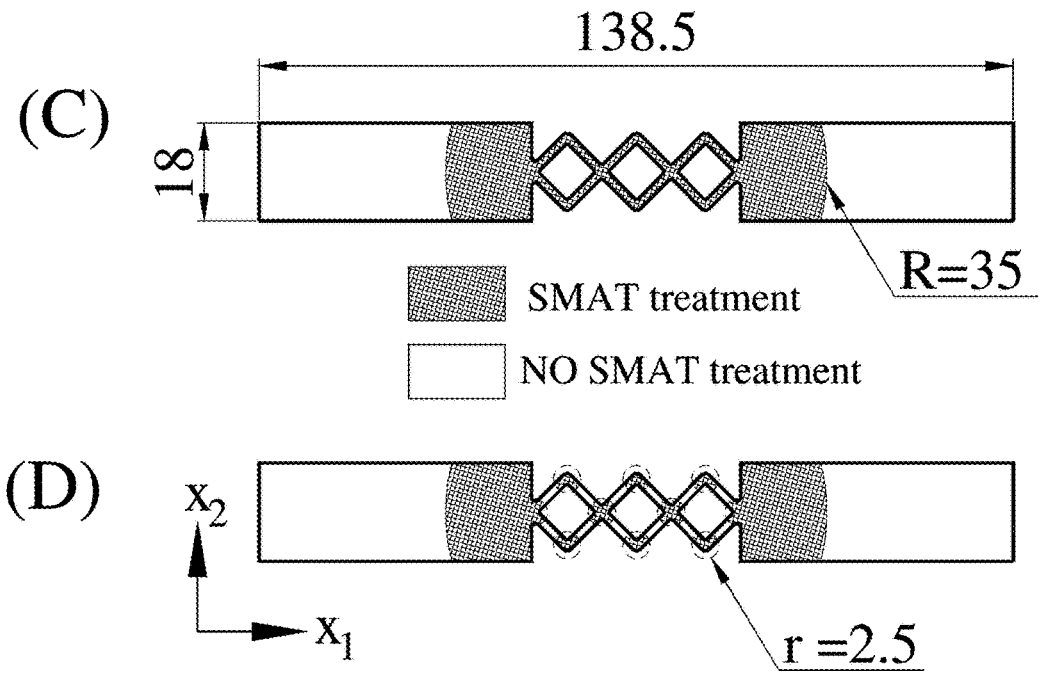

Three identical 0/90° square lattice plates were manufactured for three cases considered: no SMAT-strategy N, fully SMAT-strategy AI, and partly SMAT-strategy AII. The SMAT-treated surface areas of strategies AI and AII are shown in FIGS. 6A and 6B, respectively. Likewise, the ±45° square lattice specimens were made for three cases: no SMAT-strategy N, fully SMAT-strategy AI, and partly SMAT-strategy AIII. The SMAT areas are shown in FIG. 6C for strategy AI, and in FIG. 6D for strategy AIII.

All samples were cut from AISI 304 stainless steel sheets of thickness d=1 mm. The manufacturing route is as follows. First, steel sheets were wire-cut into three identical dog-bone plates for the 0/90° square lattice, and into three identical rectangular plates for the ±45° square lattice. For the no SMAT specimens, the central areas of the plates were wire-cut into the designed patterns, recall FIGS. 5A and 5B. For the fully SMAT specimens, the central areas were first treated with SMAT process for 3 minutes, then wire-cut into the designed geometries. The partly SMAT specimens were manufactured in the same route; however during the SMAT process, cloths were used to cover the untreated areas.

Figure 7A:
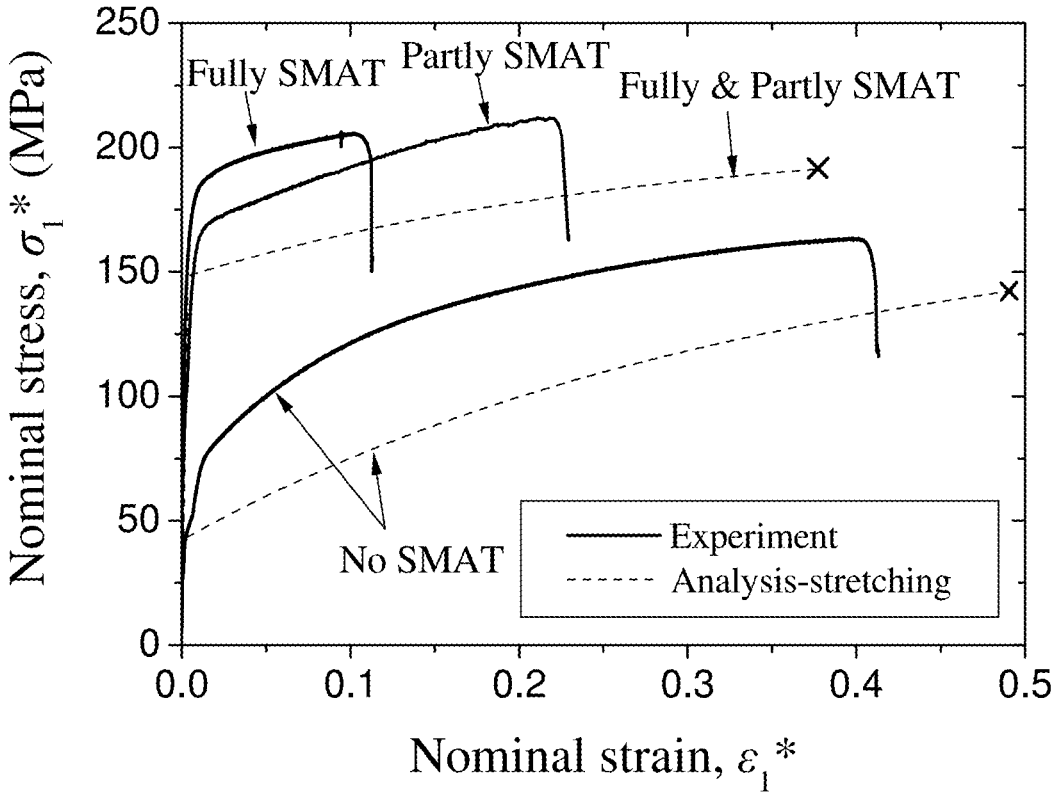
FIGS. 7A-B shows measured responses of the 0/90° square lattices and the ±45° square lattices respectively with respect to the square lattices of FIG. 6A-D.

The manufactured samples were in turn subjected to the quasi-static tensile test (along the $x_1$-axis shown in FIG. 5) at a strain rate of $\dot{\epsilon}=10^{-4}\ s^{-1}$ driven by a servo-hydraulic test machine. During the experiment, the load was recorded by the load cell of the test machine, and used to define the nominal axial stress on the net section of the specimen. The axial extension of the specimen was measured by an extensometer of gauge length 50 mm, and used to determine the nominal axial strain. The measured stress versus strain responses are shown in FIG. 7, while the optical images of the fractured samples are displayed in FIG. 8.

Consider first the results of the 0/90° square lattice. The lattice has a strut-stretching response to the uni-axial tension, and all samples exhibit an initial linear elastic behavior followed by a hardening response, see FIG. 7A. The measured yield stress of the partly SMAT specimen (strategy AII) approximately equals that of the fully SMAT specimen (strategy AI), and is more than threefold higher than that of the no SMAT specimen (strategy N). In contrast, the SMAT samples are less ductile than their no SMAT counterpart. The nominal fracture strains of the fully SMAT, partly SMAT and no SMAT samples are about 11%, 22% and 41%, respectively.

The analysis is applied here to calculate the stress-strain relation of the 0/90° square lattice under uni-axial tension. The horizontal bars a and a' resist directly the applied stretching load along the $x_1$-axis, while the vertical bars b and b' carry negligible forces, see FIGS. 6A and 6B. The bi-linear model of the parent material with and without SMAT is applied to the horizontal bars in order to calculate the nominal axial stress and strain of the lattice. These analytical calculations are included in FIG. 7A. It is clear that in the linear elastic regime, the analytical predictions of Young's modulus and yield strength are in good agreement with the measurements. Also, the partly SMAT strategy AII is as efficient as the fully SMAT strategy AI, and the value of the strengthening factor $k_s=3.5$ is adequate. In the regime of plasticity, the analyses using infinitesimal calculations moderately under-predict the measured $\sigma_1^*$ versus $\epsilon_1^*$ curves. This can be traced to the under-approximation of the bi-linear material model and the presence of strain concentrations at the nodal positions of the lattice. The fracture locations of the no SMAT specimen are three horizontal bars at the centre of the lattice plate as shown FIG. 8A. In contrast, the fully or partly SMAT specimen fails by a horizontal bar at a corner of the lattice plate, see FIGS. 8B and C.

Now consider the ±45° square lattice. Under the uni-axial load along the $x_1$-axis (FIG. 5B), the lattice exhibits an initial strut-bending deformation mode including a linear elastic behavior followed by a hardening response, see FIG. 7B. At intermediate strain such that $\epsilon_1^*>5\%$, the lattice starts switching to a strut-stretching deformation mode where the measured stress $\sigma_1^*$ increases considerably with increasing strain $\epsilon_1^*$. It is evident that in the initial bending-dominated regime, the partly SMAT specimen (strategy AIII) has an almost identical stress-strain curve as the fully SMAT specimen (strategy AI). Thus, this confirms the analytical prediction that strategy AIII is as efficient as strategy AI. For a given value of strain in the bending-dominated regime ($\epsilon_1^*<5\%$), the corresponding measured stress of strategy AI or AIII is about twice that of strategy N (no SMAT).

Figure 7B:
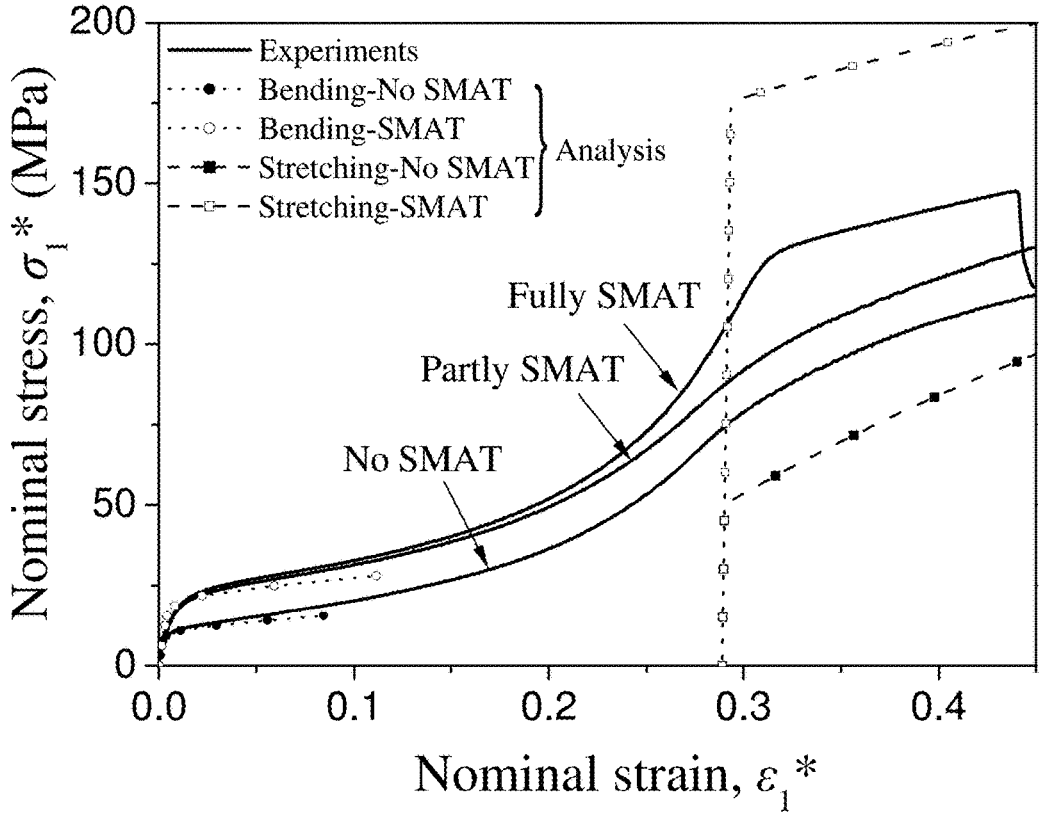
Figure 8:
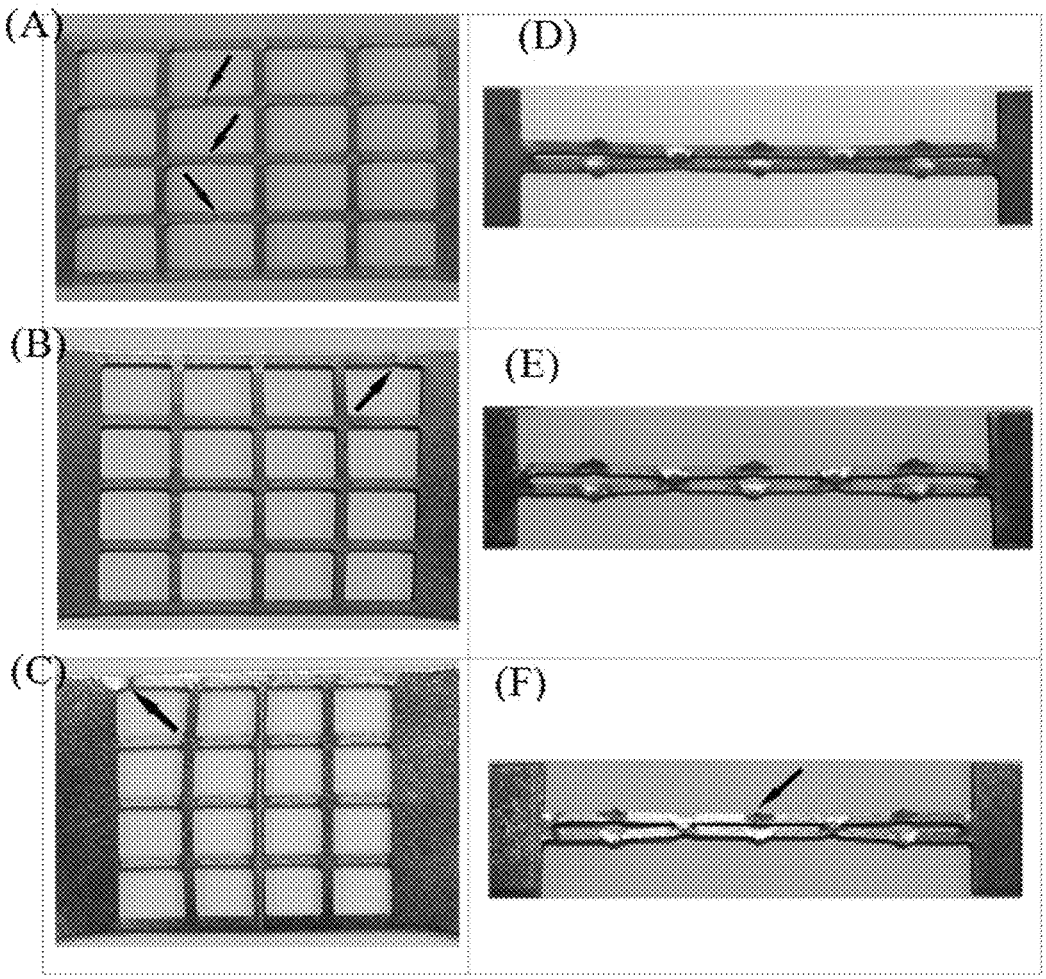
FIG. 8 shows fractured 0/90° square lattice specimens with (A) no SMAT-strategy N, (B) partly SMAT-strategy AII, and (C) fully SMAT-strategy AI respectively, and deformed ±45° square lattice specimens with (D) no SMAT-strategy N, (E) partly SMAT-strategy AIII, and (F) fully SMAT-strategy AI respectively according to an embodiment of the presently claimed invention.

Deformation analyses using infinitesimal calculations are also included in FIG. 7B for both bending-dominated and stretching-dominated regimes of the ±45° square lattice. More details of the analytical calculations are described later with the main results summarized here. In the initial strut-bending regime, each bar member is modeled as a beam undergoes bending and the beam material follows the bi-linear description. For the no SMAT specimen, the stress-strain relation of the material is described with $E_s=200$ GPa, $\epsilon_y=0.001$ and $E_t=2$ GPa. For the fully SMAT specimen, the material stress-strain relation follows with parameters taken as $E_s=200$ GPa, $\epsilon_y=0.001$, $k=k_b=2$ and $E_t^{SMAT}=2$ GPa. Here, the values of $k_b$ and $E_t^{SMAT}$ are obtained by curve-fitting the analytical model with the measured data. Thus, the SMAT strengthening factor $k_b=2$ of the ±45° square lattice is much smaller than that of the 0/90° square lattice $k_s=3.5$.

In the final stretching-dominated regime of the ±45° square lattice specimen, the material properties in the analytical model are taken as those of the 0/90° square lattice specimen. It is shown in FIG. 7B that the calculated stress-strain relation of the no SMAT specimen under-predicts the measured result. In contrast, the analytical prediction of the fully SMAT specimen over-predicts the measurement. These discrepancies can be traced to the simple assumptions in the analysis neglecting the high level of non-linearities due to material and geometry at the stage of large deformations. Nevertheless, the analysis somewhat gives a reasonable estimation of the switch in the deformation mode of the ±45° square lattice from bending to stretching.

Kagome lattices: horizontal and vertical directions, are tested and studied as follows.

SMAT strategies are selected to apply to each unit cell of the Kagome lattice as follows.

(i) Strategy Ø: no SMAT, as for comparison purposes.

(ii) Strategy BI: SMAT is applied to all bar members of the lattice, see FIG. 9A.

Figure 9:
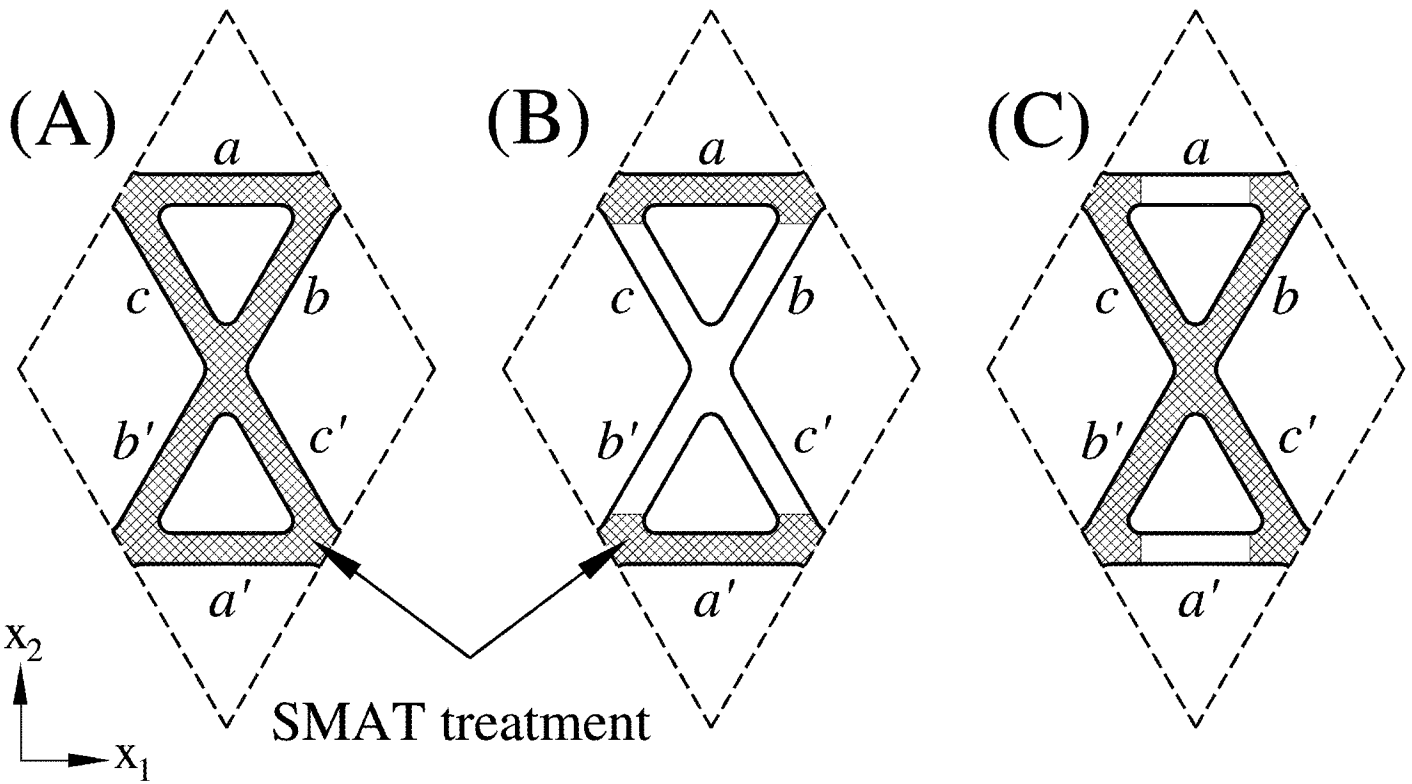
FIG. 9 shows SMAT for each unit cell of the Kagome lattice with (A) strategy BI, (B) strategy BII, and (C) strategy BIII.

(iii) Strategy BII: only the two horizontal bars a and a' are treated with SMAT, see FIG. 9B. This strategy is aimed for the loading case of uni-axial tension along the $x_1$-axis where the two horizontal bars are directly subjected to the maximum axial stresses.

(iv) Strategy BIII: only the four diagonal bars b, b', c and c' are SMAT-treated, see FIG. 9C. The strategy is for the uni-axial tension along the $x_2$-axis of the lattice. In this loading case, the four diagonal bars have the maximum axial stresses.

Figure 10:
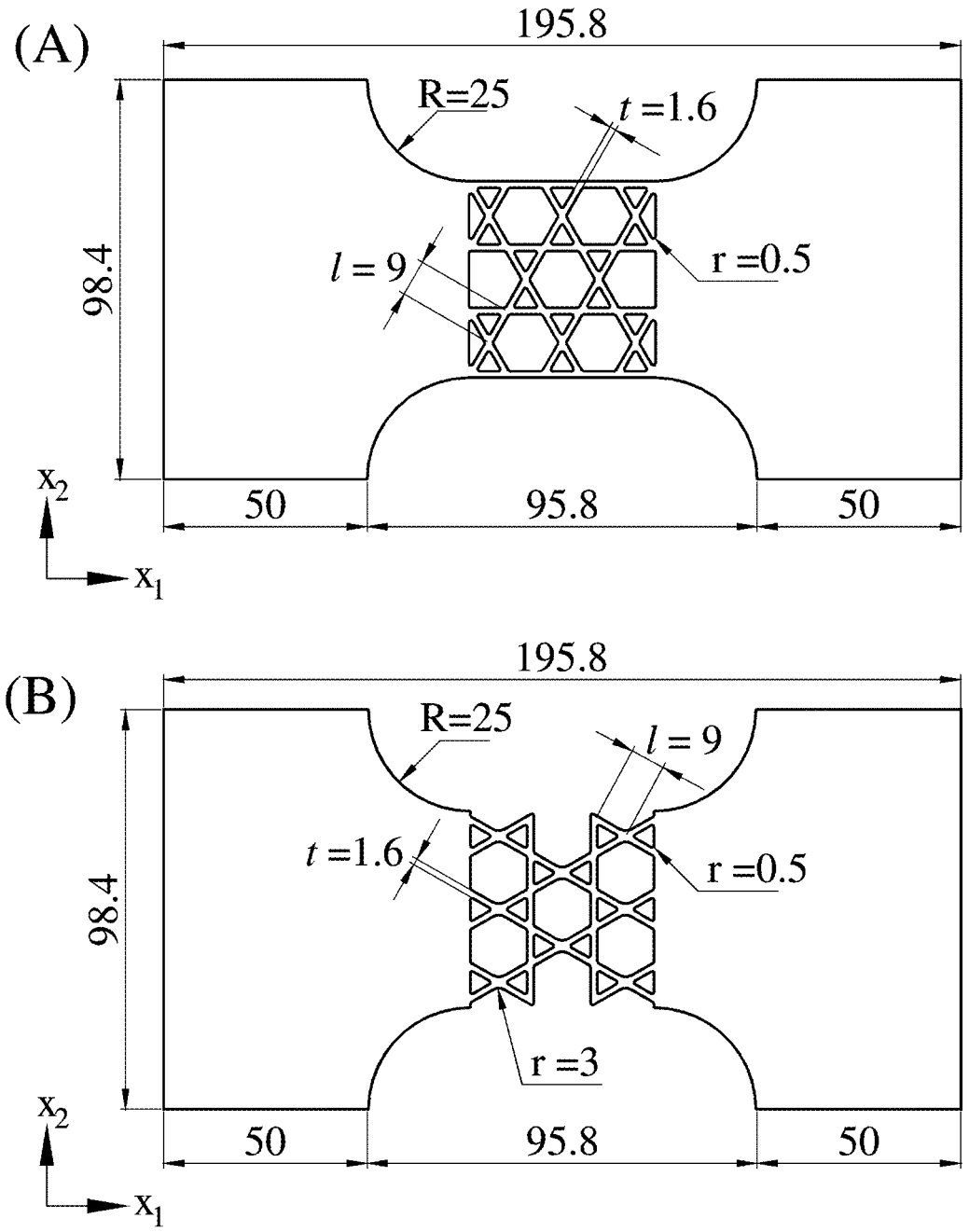
FIG. 10 shows geometries of (A) a horizontal Kagome specimen and (B) a vertical Kagome lattice specimen respectively according to an embodiment of the presently claimed invention.

Geometries of the horizontal and vertical Kagome lattice specimens are shown in FIGS. 10A and 10B, respectively. As for the square lattice, each bar member in the Kagome lattice is designed to be of length l=9 mm and width t=1.6 mm, giving the relative density $\bar{\rho}=\sqrt{3}(t/l)=0.30$ for both horizontal and vertical Kagome specimens.

Figure 11:
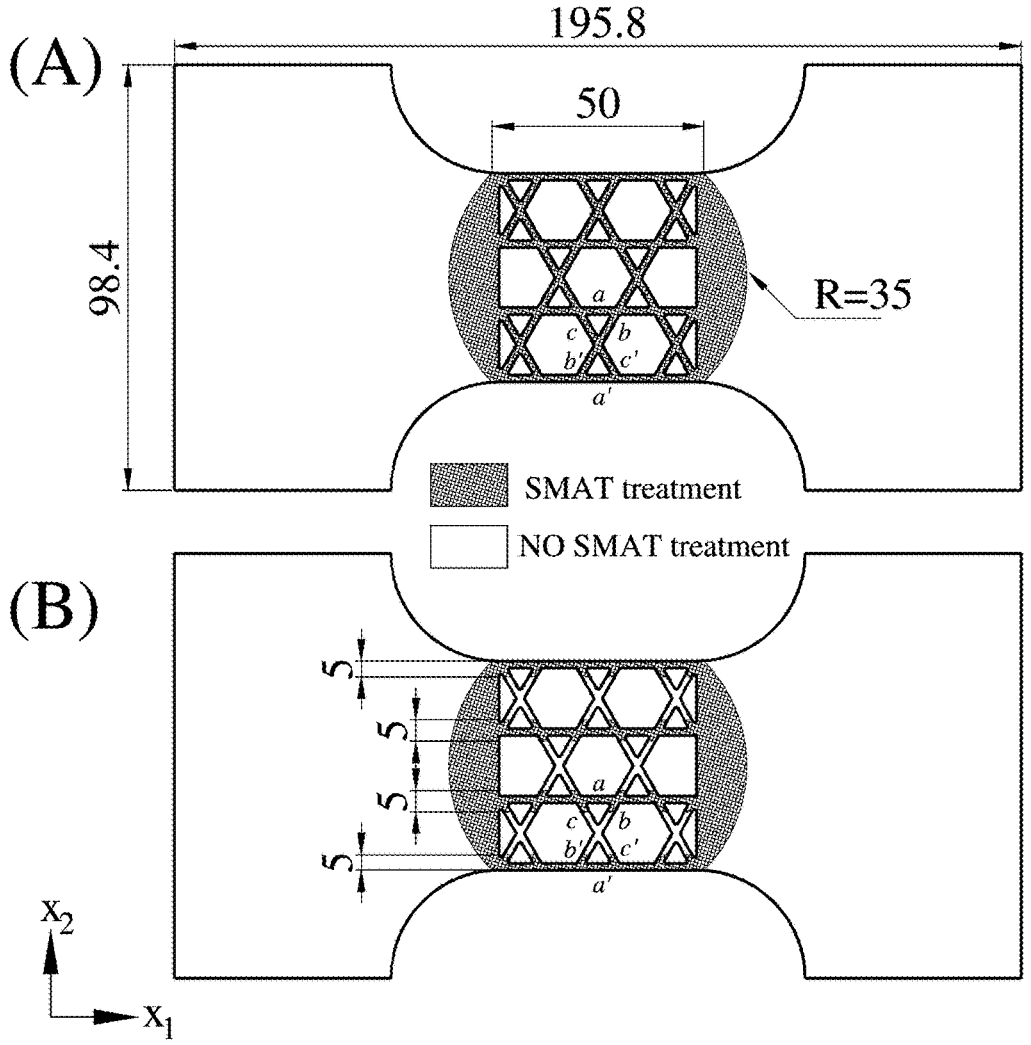
FIG. 11 shows two horizontal Kagome lattices with (A) fully SMAT-strategy BI, and (B) partly SMAT-strategy BII respectively, and two vertical Kagome lattices with (C) fully SMAT-strategy BI, and (D) partly SMAT-strategy BIII respectively according to an embodiment of the presently claimed invention.
Figure 11:
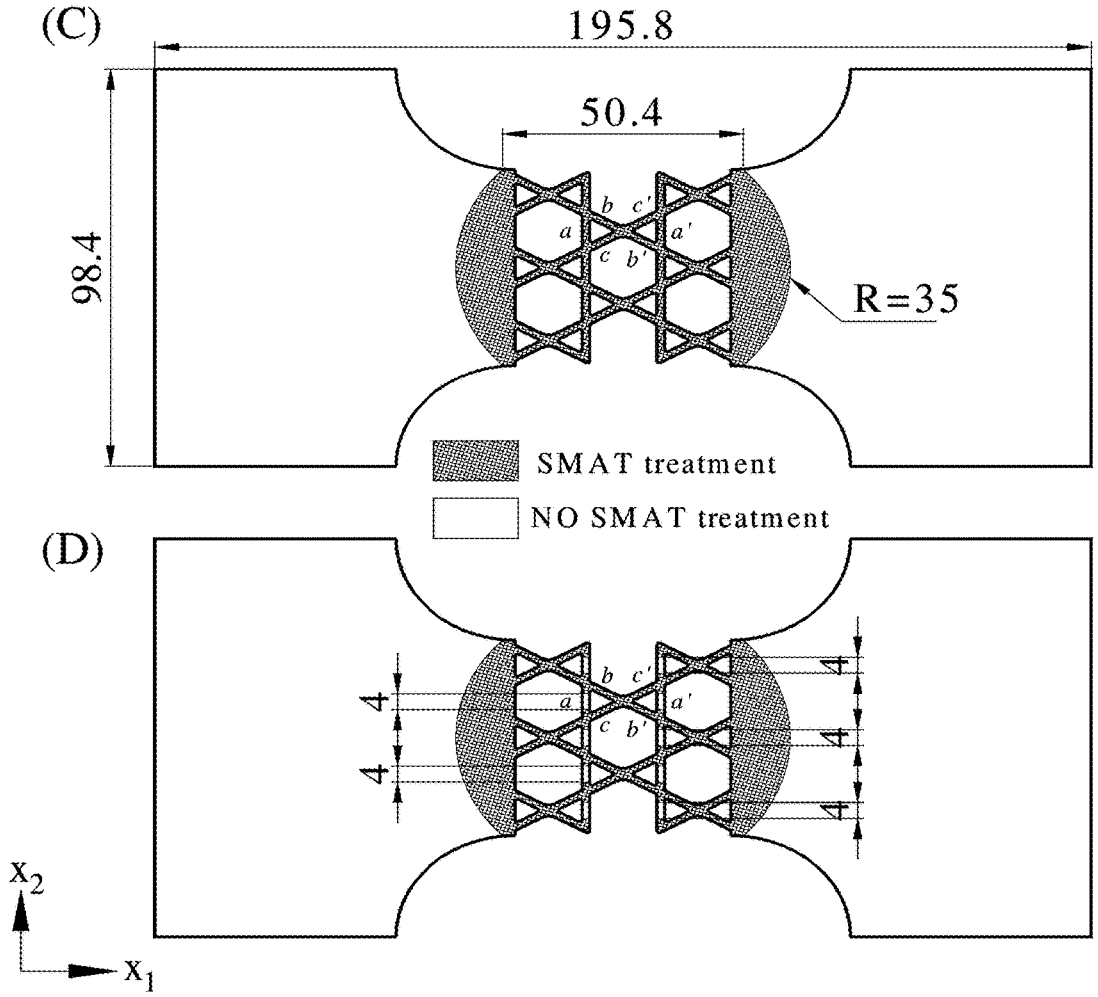

Three identical horizontal Kagome specimens were manufactured for three cases considered: no SMAT-strategy Ø, fully SMAT-strategy BI, and partly SMAT-strategy BII. The SMAT areas are shown in FIG. 11A for strategy I, and in FIG. 11B for strategy BII. Likewise, the vertical Kagome samples were made for three cases: no SMAT-strategy Ø, fully SMAT-strategy BI, and partly SMAT-strategy BIII. The SMAT-treated surface areas of strategies BI and BIII are shown in FIGS. 11C and D, respectively.

The manufacturing and testing processes of the 0/90° square lattice specimens were repeated for all Kagome lattice samples. These Kagome plates were also cut from AISI 304 stainless steel sheets of thickness d=1 mm. The SMAT duration was 3 minutes for all samples, and the untreated surface areas of the partly SMAT specimens were protected by cloths during the treatment process. The servo-hydraulic test machine and the extensometer of gauge length 50 mm were used to measure the nominal stress and strain of the Kagome specimens. The measured results are shown in FIG. 12, while the optical images of the fractured samples are displayed in FIG. 13.

Figure 12A:
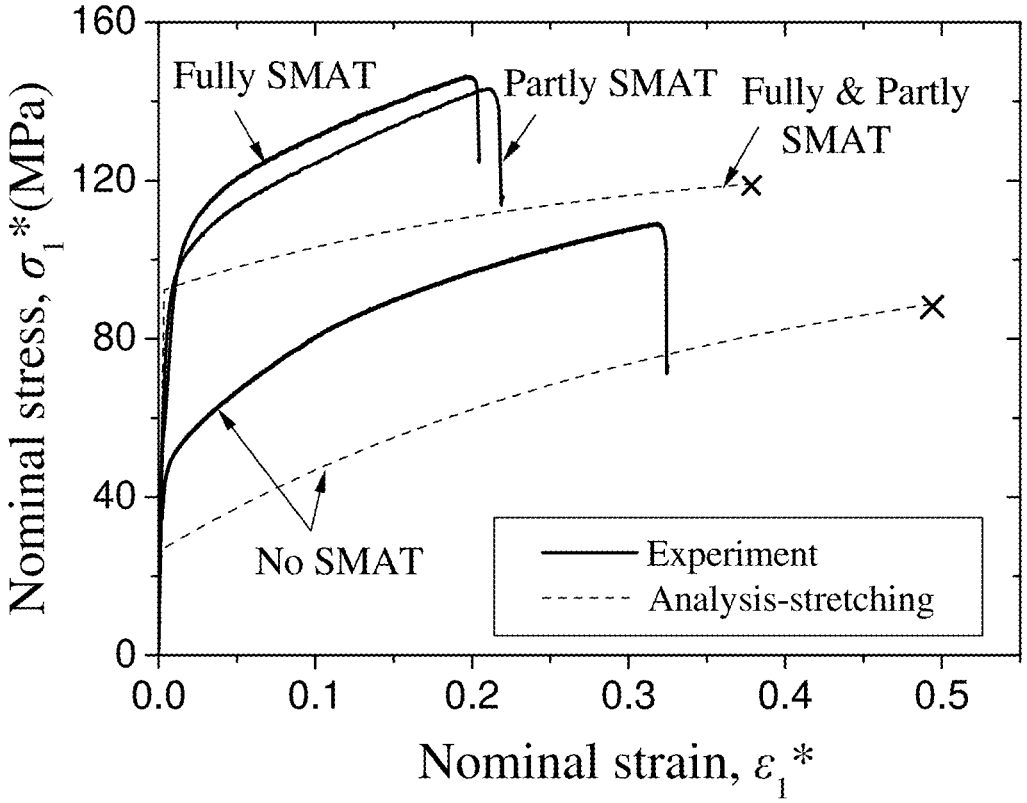
FIGS. 12A-B shows measured responses of the horizontal Kagome lattice specimens and the vertical Kagome lattice specimens respectively with respect to the Kagome lattices of FIGS. 11A-D.
Figure 12B:
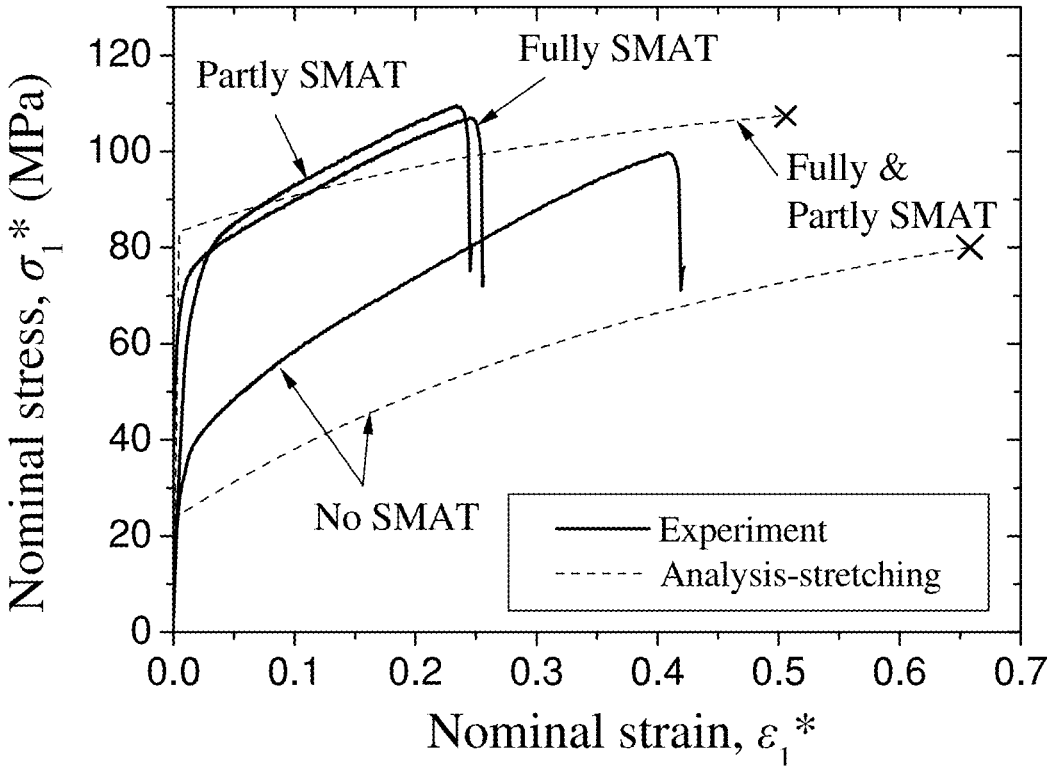
Figure 13:
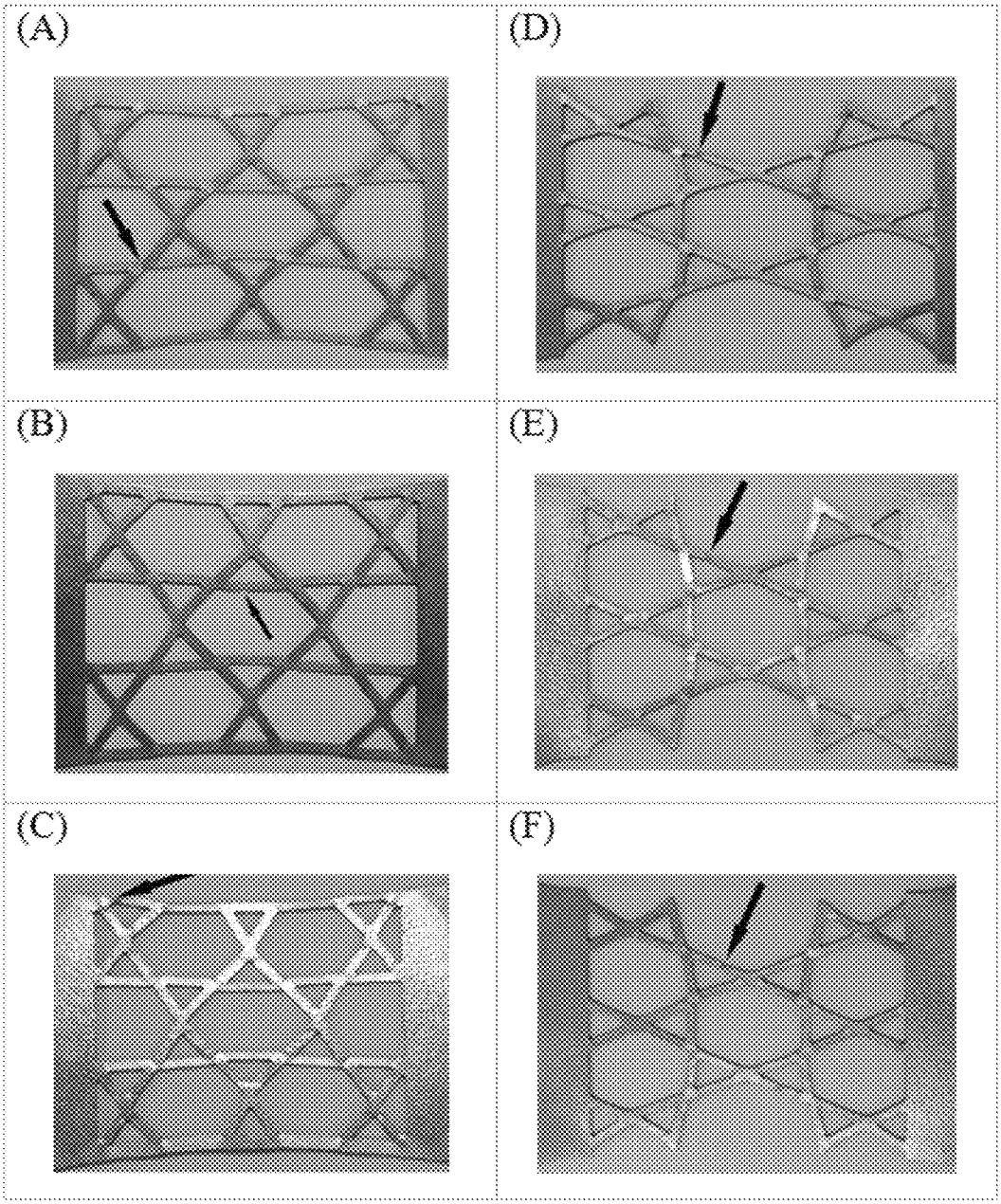
FIG. 13 shows fractured horizontal Kagome lattice specimens with (A) no SMAT-strategy Ø, (B) partly SMAT-strategy BII, and (C) fully SMAT-strategy BI respectively, and fractured vertical Kagome lattice specimens with (D) no SMAT-strategy Ø, (E) partly SMAT-strategy BIII, and (F) fully SMAT-strategy BI respectively according to an embodiment of the presently claimed invention.

The Kagome lattice is a stretching-governed structure, so both horizontal and vertical Kagome plates exhibit an initial linear behavior, followed by a hardening response, see FIGS. 12A and B. The stress-strain responses of the partly SMAT specimens in the two orientations are almost identical to those of the fully SMAT specimens. The fracture strains of the partly and fully SMAT specimens are about two thirds that of the no-SMAT specimen for both horizontal and vertical Kagome lattices. Thus, this demonstrates the reduction of material ductility due to the SMAT process.

The analytical predictions using infinitesimal calculations are also included in FIG. 12. First, consider in more detail the horizontal Kagome. The analysis shows that the tension loads along the $x_1$-axis in FIGS. 11A and B are carried by the stretching response of the horizontal bars (a and a'), while the diagonal bars (b, b', c and c') carry negligible forces. This is demonstrated by the experiments where the horizontal Kagome samples fail by the fracture of horizontal bars in various positions as shown in FIGS. 13A, B and C. Thus, apply the bi-linear material description to the horizontal bars in order to calculate the nominal axial stress and strain of the lattice, while neglecting the small effect of the diagonal bars. This simple method gives good predictions within the linear elastic regime for all SMAT and no-SMAT specimens as shown in FIG. 12A. Also, the value of the strengthening factor due to the SMAT process $k_s$=3.5 is adequate. For the plastic regime, the analytical calculations under-predict the measured responses in all cases. This can be explained by the high level of non-linearity due to the strain concentration around nodal positions in the lattice, and the under-approximated bilinear material model.

Last, consider the analysis of the vertical Kagome lattice. As analyzed, the stretching of the diagonal bars (b, b', c and c') is the dominant response to the tension loads along the $x_1$-axis shown in FIGS. 11C and D. This is confirmed by the experiments where all vertical Kagome samples fracture at a diagonal bar at mid-span of the lattice, see FIGS. 13D, E and F. Thus, the bi-linear material model is applied to the diagonal bars to calculate the stress-strain relation of the lattice, while neglecting the small effect of the vertical bars (a and a'). For the SMAT specimens, the predicted yield stress (using the strengthening factor $k_s$=3.5) is slightly higher than the measured value, and the predicted fracture strain is about twice that of the measurement, see FIG. 12B. For the no-SMAT specimen, the analytical calculation is in good agreement with the measurement within the elastic regime, but under-predicts the measured response in the plastic regime. Similar to the 0/90° square and horizontal Kagome lattices, the analytical under-predictions in the plastic regime of the vertical Kagome lattice can be ascribed to the under-approximation of the bilinear material model and the strain concentrations around nodal positions in the lattice.

In the invention, the strengthening effect of SMAT method is explored for two types of lattices: square and Kagome by analysis and experiment. It is found that the SMAT method is most efficient when it is applied to the locations of high stress concentrations. For bending-dominated structures (the ±45° square lattice under uni-axial tension), the highest reinforcing efficiency is achieved by applying SMAT to the vicinity of bar ends where stresses are most concentrated. In this case, the yield strength of lattice specimens made from 304 stainless steel sheets is increased by a factor of $k_b$=2 through the SMAT process used in the current study. For stretching-dominated structures (the 0/90° square lattice under axial deformation and the Kagome lattice under any macroscopic loading), the strengthening efficiency is maximised when the SMAT is applied over the entire bar members whose axial stresses exceed the elastic limit of the parent materials. In this case, the SMAT strengthening factor upon the yield stress is $k_s$=3.5 for all steel lattice samples tested.

The ability to create structural materials of high yield strength and yet high ductility has been a dream for materials scientists for a long time. The study of the mechanical behavior of the surface nanostructured materials using SMAT shows significant enhancements in mechanical properties of the nanostructured surface layer in different materials.

Deformation regimes of the ±45° square lattice under uni-axial tension are discussed as follows.

The ±45° square lattice has two dominant regimes of deformation: (i) the initial strut-bending and (ii) the final strut-stretching. The stress-strain analysis using infinitesimal calculations is performed here for each mode of deformation.

Regime I: Strut-Bending Deformation Mode

Figure 14:
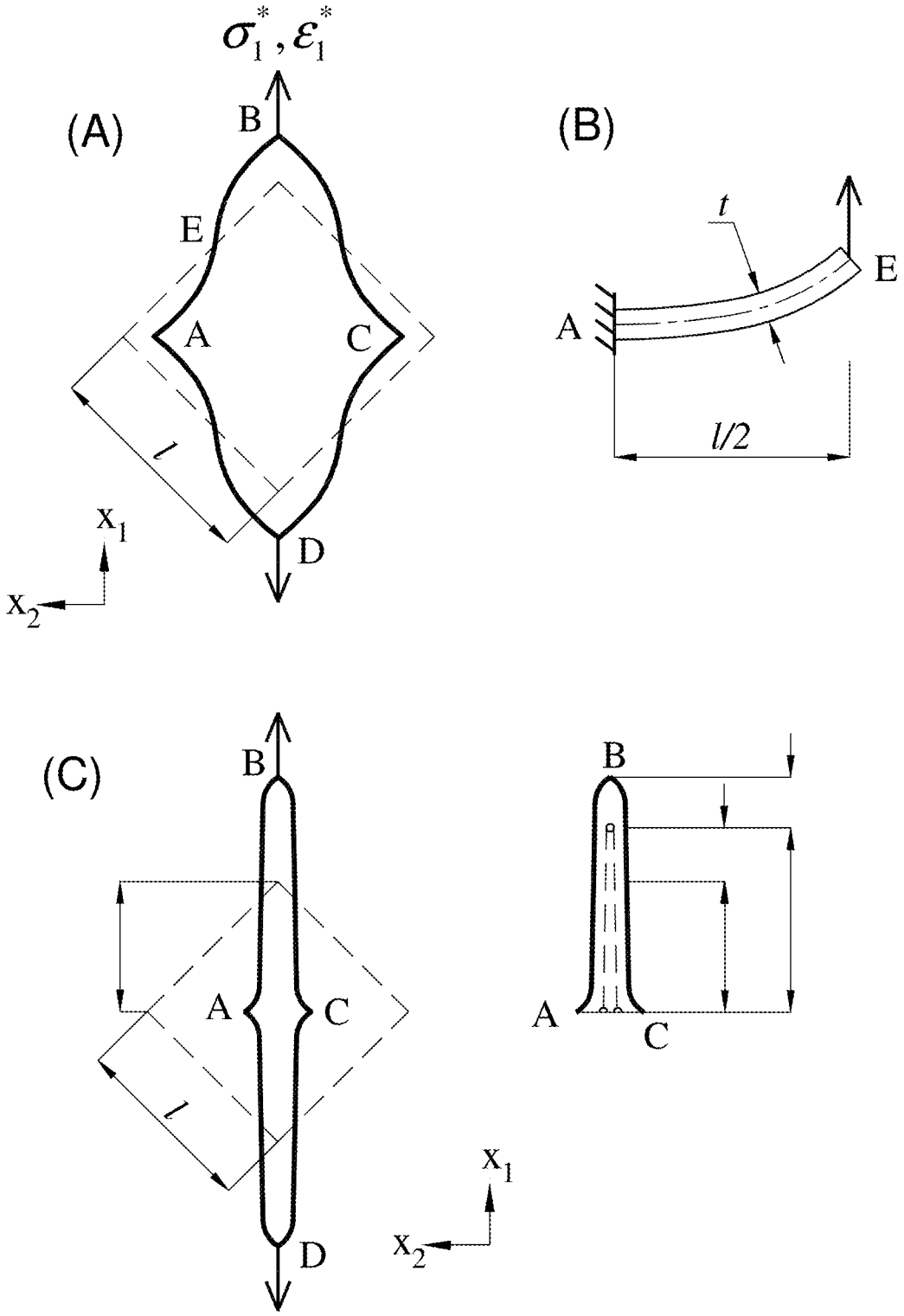
FIG. 14 shows uni-axial tension of (A) a ±45° square lattice with an initial bending-dominated regime, (B) a bending of a half of the beam element, and (C) a stretching-dominated regime respectively according to an embodiment of the presently claimed invention.

The initial bar-bending response of the ±45° square lattice to the uni-axial tension load is illustrated in FIG. 14A. The stress-strain relation of the lattice is determined by analyzing the bending of a half of a representative bar member, as sketched in FIG. 14B. The nominal stress of the lattice $\sigma_1$* related to the transverse load P as $$\sigma_1^* = \frac{2P}{dl} \tag{A.1}$$

where d is the depth of the lattice, and l is the length of each bar member. The nominal strain of the lattice $\delta_1$* is associated with the tip deflection δ as $$\varepsilon_1^* = \frac{2\delta}{l}. \tag{A.2}$$

Recall from the experiments that d=1 mm is the thickness of the 304 stainless steel sheets, whilst t=1.6 mm and l=9 mm are the width and length of each bar member in the designed lattice specimens. Due to the stubbiness of the bar members, the bar length in our calculations is taken as l'=l−t=7.4 mm.

The inelastic bending of a cantilever beam made from a bi-linear material is analysed by Fertis (1999) using the method of the equivalent systems. The lengthy process of this approximation method is omitted and the reader is referred to Feris (1999) for more details. Here, their methodology to determine the relation of the load P and the tip deflection δ for two cases is applied: the beam is untreated with SMAT, and the beam is fully treated with SMAT. Again, the bi-linear material approximations are applied for these two cases considered. For the no SMAT lattice, the material properties are those of the original steel sheets: $E_s$=200 GPa, $\epsilon_y$=0.001 and $E_t$=2 GPa. For the fully SMAT lattice, the initial Young's modulus and yield strain are unchanged as $E_s$=200 GPa and $\epsilon_y$=0.001. The two SMAT parameters are obtained by curve-fitting with the measured data as $k=k_b=2$ and $E_t^{SMAT}$=2 GPa. The nominal stress and strain ($\sigma_1^*,\epsilon_1^*$) of the lattice derived are shown in FIG. 7B for both no SMAT and fully SMAT specimens, and these are in good agreement with the measurements.

Regime II: Strut-Stretching Deformation Mode

Suppose that all nodes in the ±45° square lattice are pin-jointed. Under the infinitesimal tension force, the bar members are pulled from the initial diamond shape into a straight configuration due to the collapse mechanism of the lattice, see FIG. 14C. At this stage, all bars are aligned in the direction of the stretching force along the $x_1$-axis. This is defined as the locking stage as the bars start stretching with increasing applied force. The locking length $h_L$ of a half of the unit cell is $$h_L=h_0+\Delta h_L=h_0(1+\epsilon_L^*) \tag{A.3}$$

where $h_0=l/\sqrt{2}$ and the locking strain is $$\varepsilon_L^* = \frac{\Delta h_L}{h_0}. \tag{A.4}$$

The nominal strain of the lattice is determined as $$\varepsilon_1^* = \frac{\Delta h_L + \Delta h}{h_0} = \varepsilon_L^* + \varepsilon\left(\frac{h_L}{h_0}\right) \tag{A.5}$$

where $\epsilon=\Delta h/h_L$ is the engineering strain of the bar member. The nominal stress of the lattice $\sigma_1^*$ is related to the stretching stress of the bar member $\sigma$ as $$\sigma_1^* = \frac{\sqrt{2}\,t}{l}\sigma. \tag{A.6}$$

The initial height of the ±45° square lattice specimens is $h_0=l/\sqrt{2}$=6.4 mm. The bar members are relatively stubby, so the locking length is taken as $h_L=l-t/2$=8.2 mm leading to the locking strain $\epsilon_L^*=h_L/h_0-1$=0.29. The material properties of the specimens are taken as those given: $E_s$=200 GPa, $\epsilon_y$=0.001 and $E_t$=2 GPa for the no SMAT sample; and $E_s$=200 GPa, $\epsilon_y$=0.001, $k_s$=3.5 and $E_t^{SMAT}$=1.7 GPa for the fully SMAT sample. The stress-strain relations of the lattice derived are shown in FIG. 7B for both no SMAT and fully SMAT specimens.

The following examples or embodiments are intended to better illustrate the presently claimed application of SMAT with 316L SS balls or $ZrO_2$ balls on treating surfaces of metal substrate of medical implant (e.g. stent) in order to result in a material with high yield strength and hardness, low cytotoxicity, cytocompatibility to endothelial cells and hemocompatibility suitable for making medical implant such as stent used in cardiovascular disease patient in needs thereof. It will be apparent to those skilled in the art that modifications, including additions and/or substitutions, may be made without departing from the scope and spirit of the presently claimed invention. Specific details may be omitted so as not to obscure the presently claimed invention; however, the disclosure is written to enable one skilled in the art to practice the teachings herein without undue experimentation:

Example 1

Figure 15:
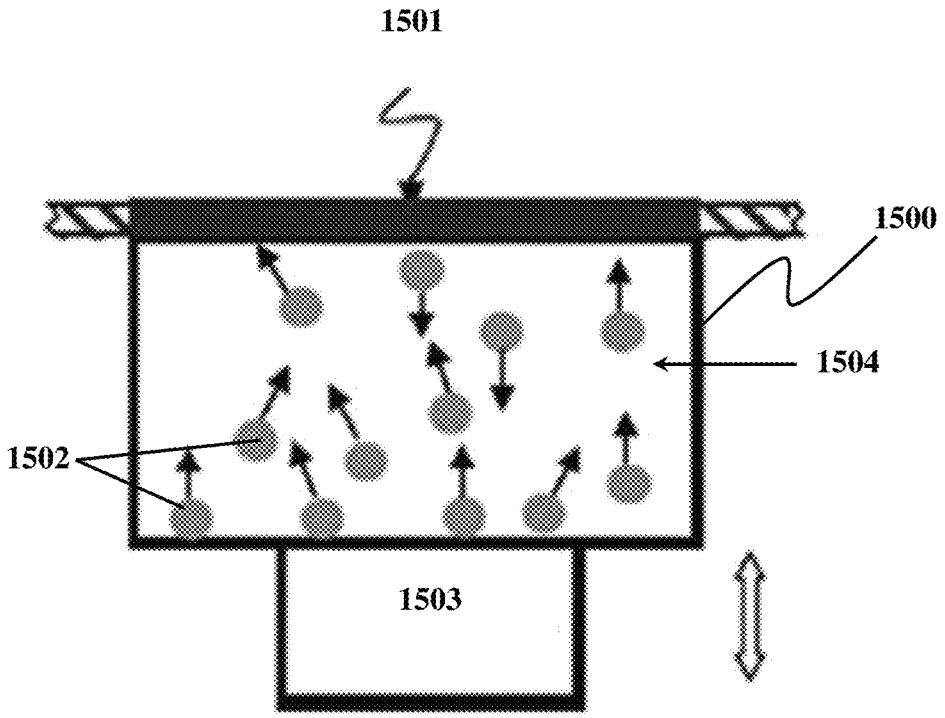
FIG. 15 shows a schematic diagram of an experimental setup of how SMAT and the balls are applied on metal substrate of a medical implant according to an embodiment of the present invention.

FIG. 15 is a schematic diagram illustrating the setup and a metal substrate (1501) of a medical implant is treated by SMAT with the presently claimed balls under certain conditions. The presently claimed method comprises applying either 316L stainless steel balls or Zirconium oxide ($ZrO_2$) balls (1502) in a size of about ϕ3.0 mm to the metal substrate. The preference of the balls to be used for SMAT to treat metal substrate for medical implant is $ZrO_2$ balls due to the resulting physical and mechanical properties of the medical implant, and the benefits to the cell growth or tissue regeneration around the medical implant. The metal substrate 1501 to be treated by SMAT and the balls is 316L stainless steel plate (mirror polished) and in a dimension of 100 mm×50 mm×0.9 mm. The total weight of the balls 1502 used in this example to treat both sides of the metal substrate is about 20 g. SMAT with the presently claimed balls to be applied to the metal substrate is carried out in an enclosure (1500) with a chamber (1504). On one side of the chamber 1504, the metal substrate to be treated is held in a position almost opposite to a vibrating means (1503) which is located on another side of the chamber 1504. The balls 1502 are moved back and forth inside the chamber by the vibrating motion of the vibrating means. The vibrating frequency of the vibrating means for moving the balls in the chamber of the enclosure is about 20,000 Hz. The working amplitude of the vibrating means 1503 is about 80%. The treatment time on each side of the metal substrate is crucial to the properties of the metal substrate. A preferred treatment time on each side of the metal substrate is about 15 minutes, or above. That means the total time for treating both sides of the metal substrate is about 30 minutes. The 30-minute time course of treating both sides of the metal substrate by SMAT with the presently claimed balls is divided into four intervals: (i) from 0 to $1^{st}$ minute; (ii) from $1^{st}$ minute to $5^{th}$ minute; (iii) from $5^{th}$ to $29^{th}$ minute; and (iv) from $29^{th}$ minute to $30^{th}$ minute. At each time interval, the average duration per strike using the presently claimed balls to perform SMAT on each side of the metal substrate ranges from 5 seconds up to 15 seconds per strike. There is an on/off button used to control balls vibration for achieving different durations per strike, and the plate samples are usually turned-over after finishing one strike. The following scheme of treatment is used in this example:

- From 0 to $1^{st}$ minute: 5 seconds per strike on each side of the metal substrate;
- From $1^{st}$ to $5^{th}$ minute: 10 seconds per strike on each side of the metal substrate;
- From $5^{th}$ to $29^{th}$ minute: 15 seconds per strike on each side of the metal substrate;
- From $29^{th}$ to $30^{th}$ minute: 10 seconds per strike on each side of the metal substrate×4 times followed by 5 seconds per time on each side of the metal substrate×4 times Since the 316L plate is thin, long consistent treatment by SMAT on one side of the plate may bend the substrate, making the plate be difficult to recover. The above scheme of treatment time can avoid such problem occurred.

At the first time interval (from 0 to $1^{st}$ minute), each side of the metal substrate is treated by the presently claimed balls for 6 strikes at 5 seconds per strike. At the second time interval (from $1^{st}$ to $5^{th}$ minute), each side of the metal substrate is treated by the presently claimed balls for 12 strikes at 10 seconds per strike t. In the third time interval, each side of the metal substrate is treated by the presently claimed balls for 48 strikes at 15 seconds per strike In the fourth time interval (from $29^{th}$ to $30^{th}$ minute), each side of the metal substrate is treated by the presently claimed balls for 2 strikes at 10 seconds per strike and then for 2 strikes at 5 seconds per strike.

Example 2

Figure 16:
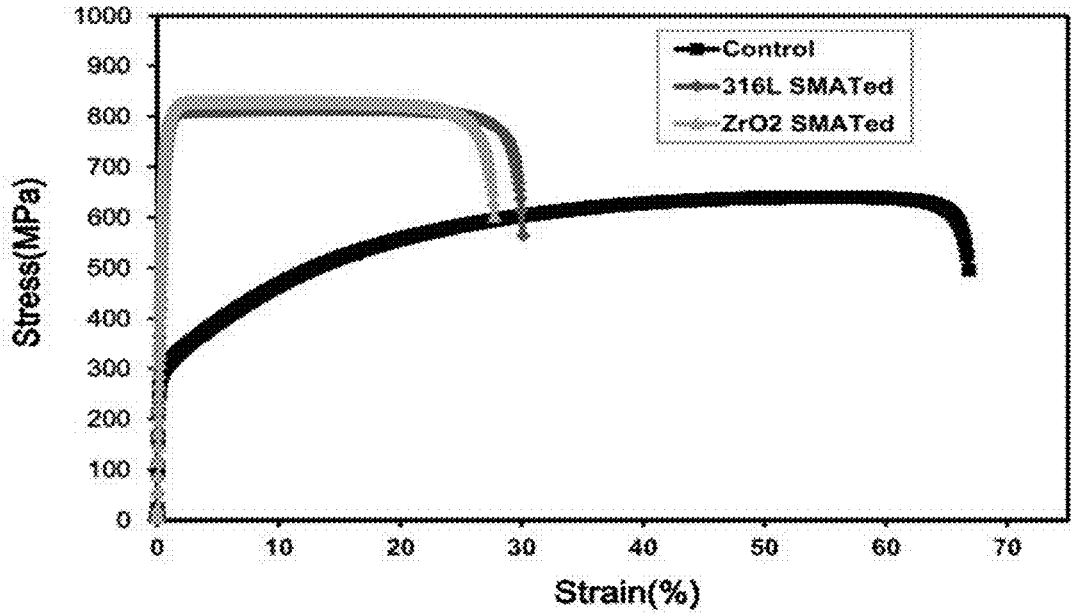
FIG. 16 shows tensile strength test result of metal substrate samples treated by SMAT and with different balls of the present invention.
Figure 17:
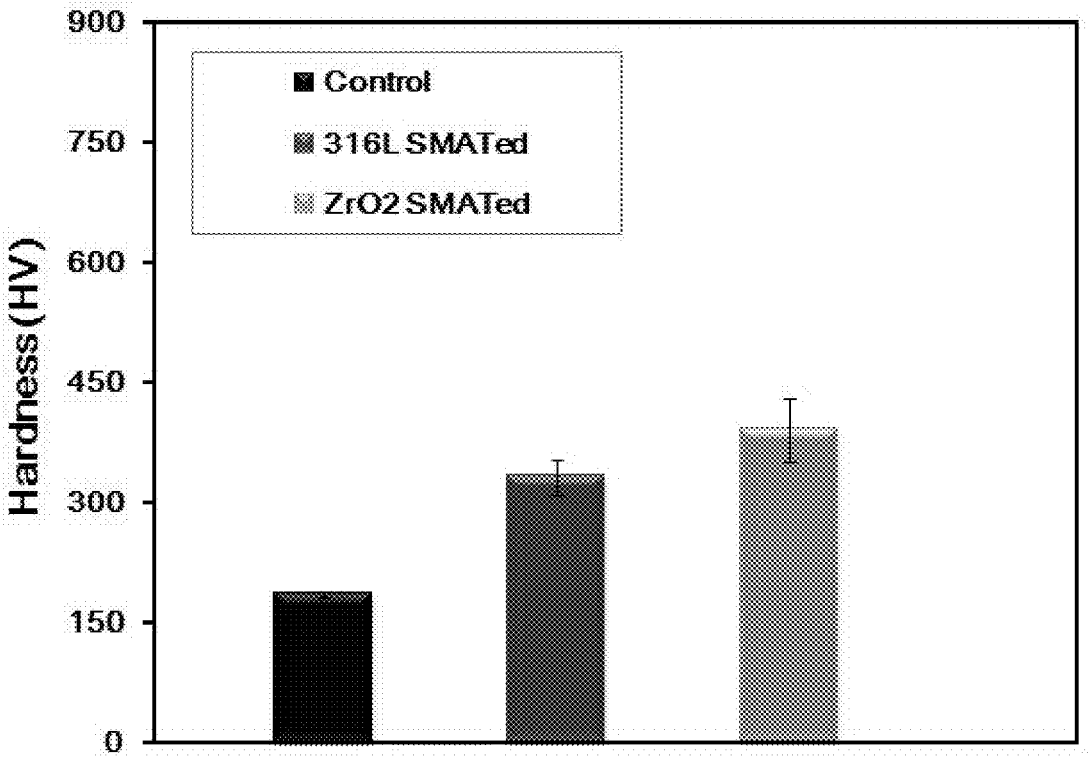
FIG. 17 shows the hardness test result of metal substrate samples treated by SMAT and with different balls of the present invention.

Yield strength and hardness of the metal substrate (316L SS plate with mirror polished) treated by SMAT with 316L SS balls or $ZrO_2$ balls according to Example 1 are tested. The metal substrate obtained from the method described in Example 1 is cut into smaller pieces as 10×10×0 9 mm per piece for testing in this example. Both metal substrate samples treated by 316L SS balls (316L SMATed) and treated by ZrO2 balls ($ZrO_2$ SMATed) have significant improvement in the yield stress but the strain is compromised (FIG. 16); Both 316L SMATed and $ZrO_2$ SMATed metal substrate sample shows improvements in hardness, especially the $ZrO_2$ SMATed metal substrate (FIG. 17).

Example 3

Figure 18:
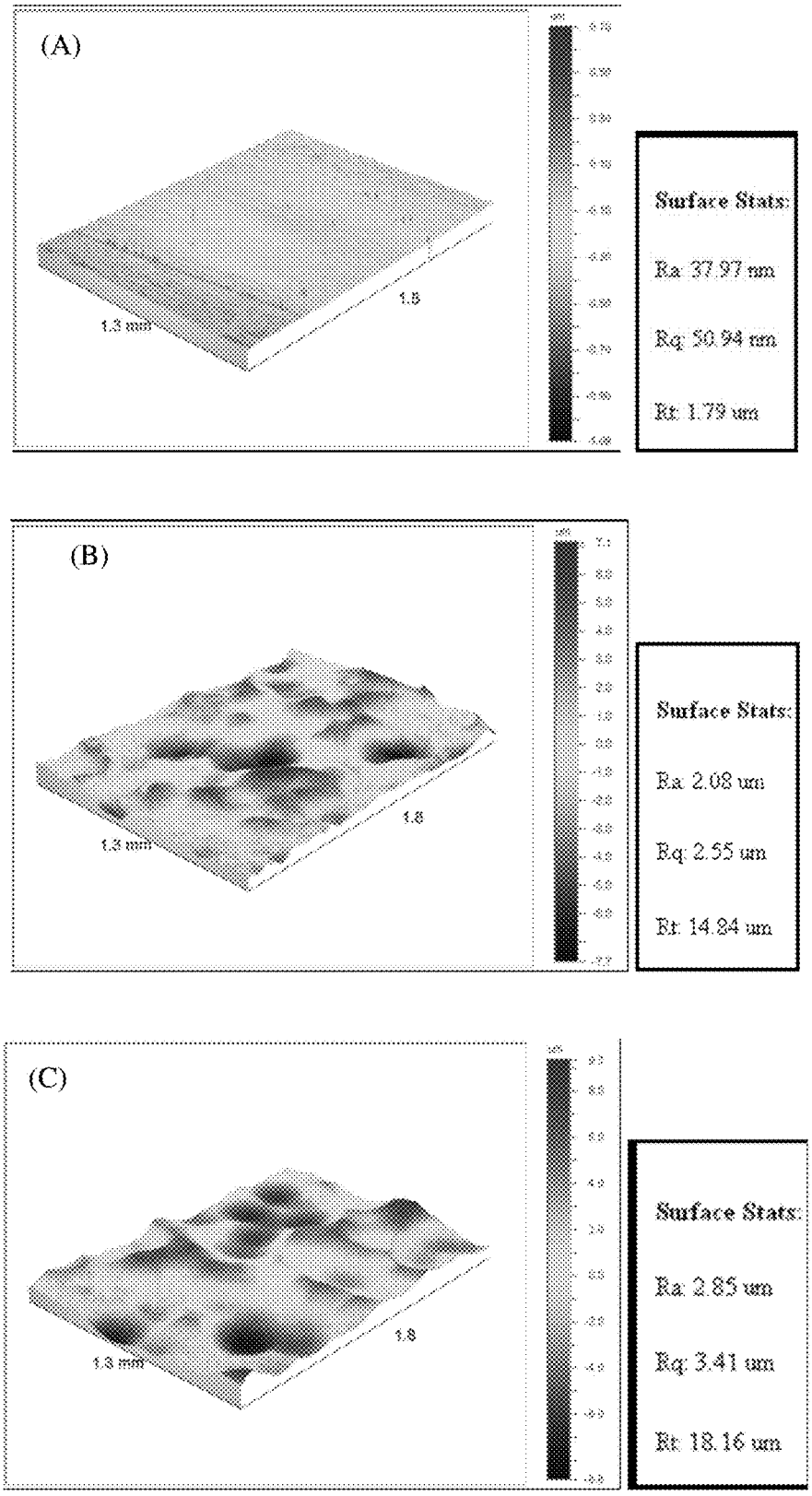
FIG. 18 shows topographical characterization of different metal substrate by optical profilometry: (A) untreated; (B) 316L SS balls SMATed; (C) $ZrO_2$ balls SMATed.

As shown in FIG. 18, the topographies of untreated metal substrate (control) and the SMAT treated metal substrate (SMATed) are quite different. In particular, the control sample (FIG. 18A) is relatively flat whereas the SMATed samples have some obvious attrition traces. Interestingly, the sample morphologies arising from 316L SS balls attrition (FIG. 18B) are different from those from $ZrO_2$ balls attrition (FIG. 18C). The 316L SMATed sample has some scratches and holes whereas some shaded areas are noticeable on the $ZrO_2$ SMATed sample. It is believed that this difference is due to different mechanical diversity between 316L SS and $ZrO_2$ balls. Further characterization of sample topographies by optical profilometry reaches the same conclusions, and it is disclosed by optical profilometry that the surface roughness of 316L SMATed sample (Ra=2.08 μm) and $ZrO_2$ SMATed samples (Ra=2.85 μm) are exponentially higher than that of the control (Ra=0.038 μm).

Example 4

Figure 19:
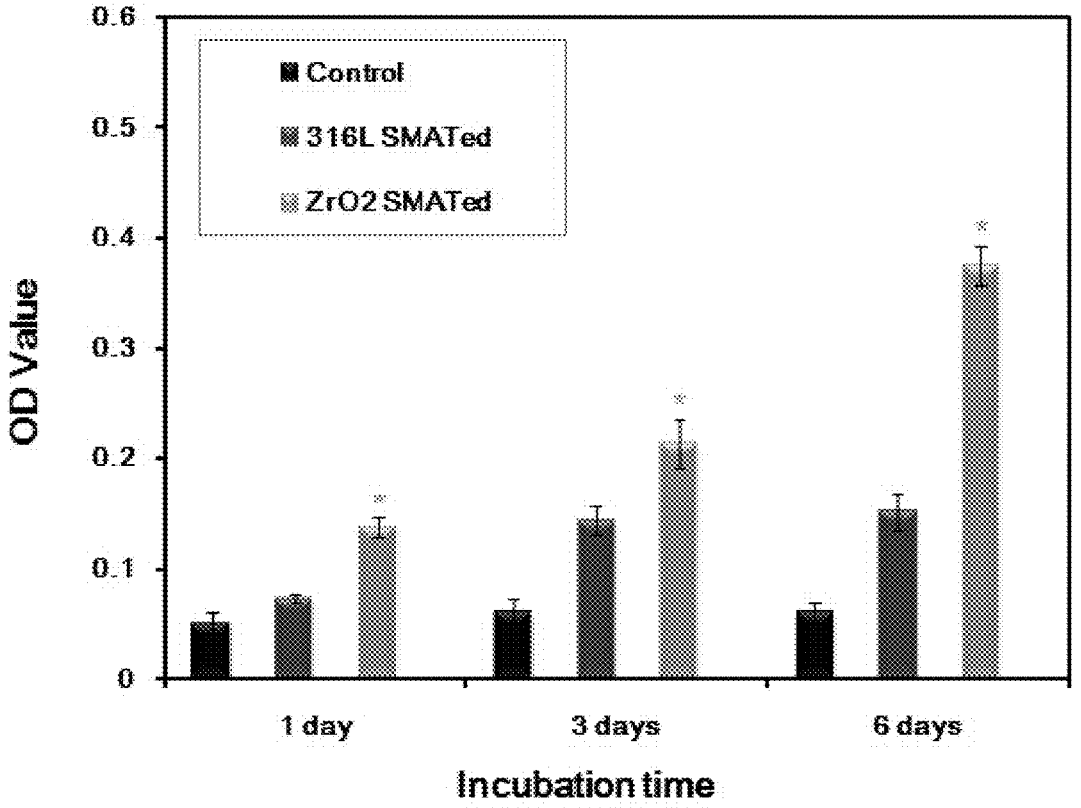
FIG. 19 shows the result of a time-dependent viability test of metal substrate samples treated by SMAT with different balls of the present invention on endothelial cells EA. hy926 cells: One-way ANOVA is utilized to determine the level of significance, * the highest OD value (the best viability of endothelial cells on samples); $p<0.05$.

Cytocompatibility of various samples (untreated and SMATed metal substrate) is determined by seeding endothelial cells (EA.hy926, ATCC® CRL-2922TM) on the metal substrate samples and the cells are cultured for different time frame. As indicated by FIG. 19, the cell viability on $ZrO_2$ SMATed samples are the best among all. This is probably owing to that $ZrO_2$ is a kind of biocompatible ceramic and some $ZrO_2$ components are introduced into the metal substrate after SMAT with $ZrO_2$ balls.

Example 5

Figure 20:
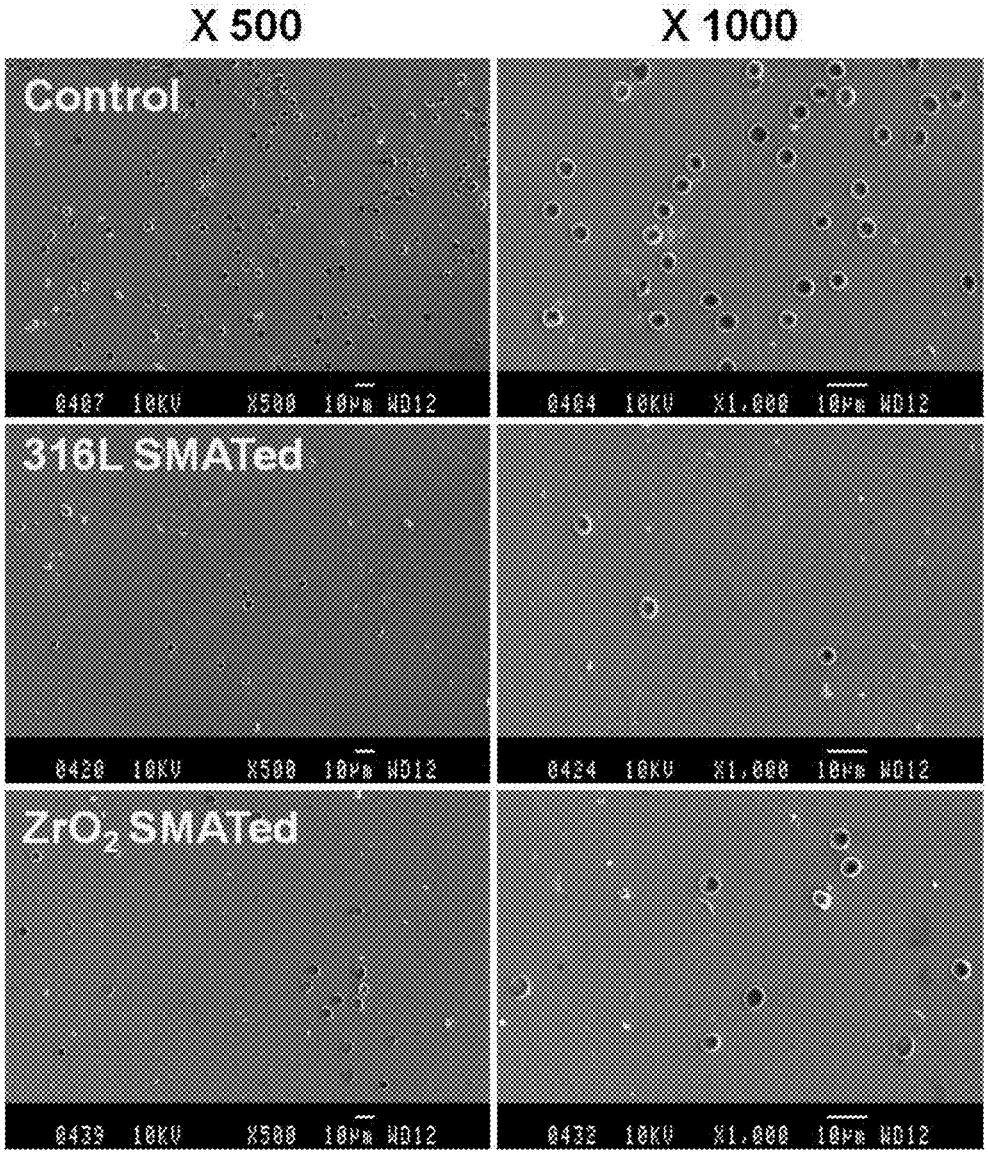
FIG. 20 shows SEM photos of erythrocytes attached on metal substrate samples treated by SMAT with different balls of the present invention: magnification×500 (left column) and ×1000 (right column)
Figure 21:
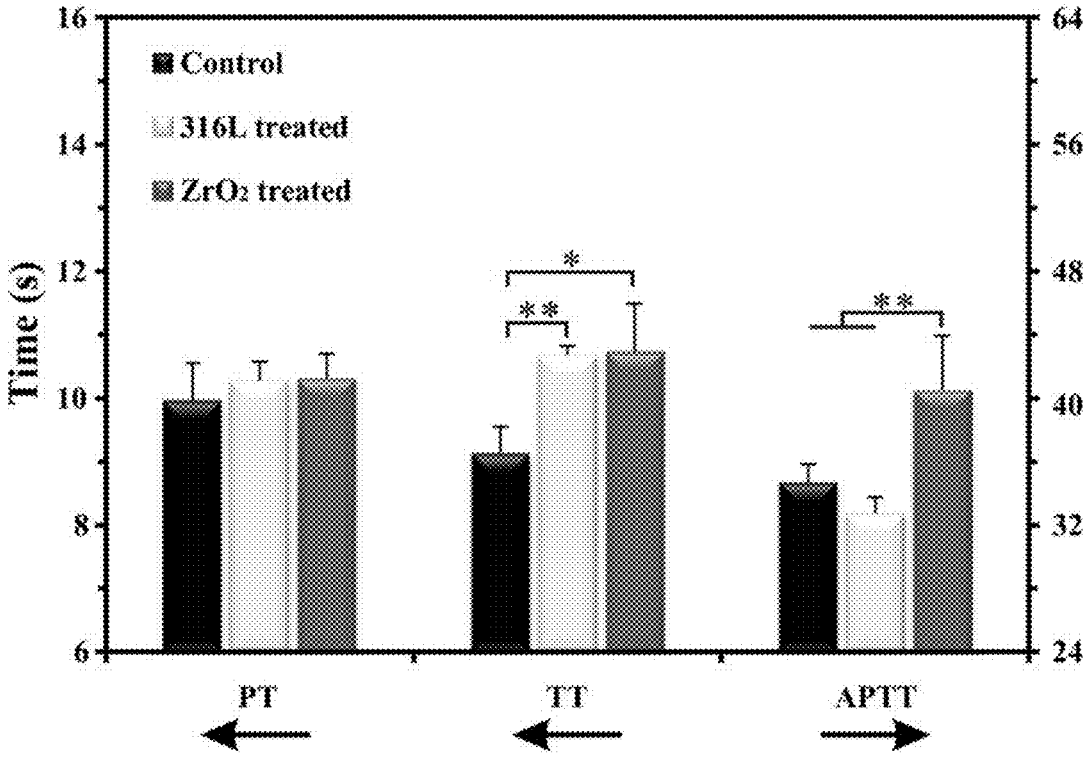
FIG. 21 shows the change in prothrombin time (PT), thrombin time (TT) and activated partial thromboplastin time (APTT) of erythrocytes from platelet-poor plasma (PPP) seed on metal substrate samples treated by SMAT and with different balls of the present invention.

Hemocompatibility is determined by seeding erythrocytes on untreated and SMATed metal substrate samples. The erythrocytes attached on SMATed samples (FIG. 20, second and third rows of microscopic images) are much less than those on untreated samples (FIG. 20, first row of microscopic images). As shown in FIG. 21, there is no difference of Prothrombin time (PT) from various samples. However, thrombin time (TT) on metal substrate can be developed by both SMAT processes, and $ZrO_2$ SMATed sample is even better than the control and 316L SMATed samples in activated partial thromboplastin time (APTT).

Example 6

Figure 22:
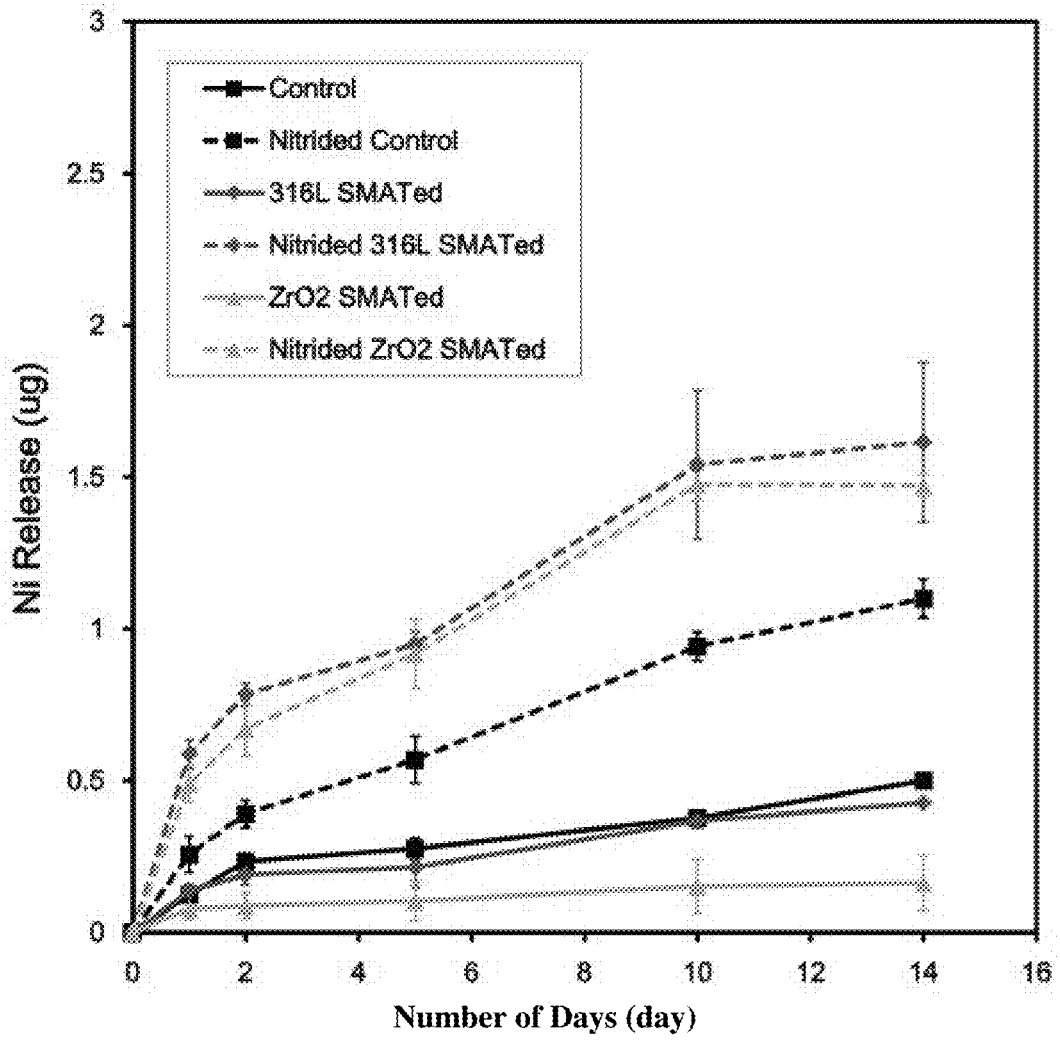
FIG. 22 shows Ni release profile of metal substrate samples treated by SMAT with different balls of the present invention and with/without treatment by plasma nitriding.
Figure 23:
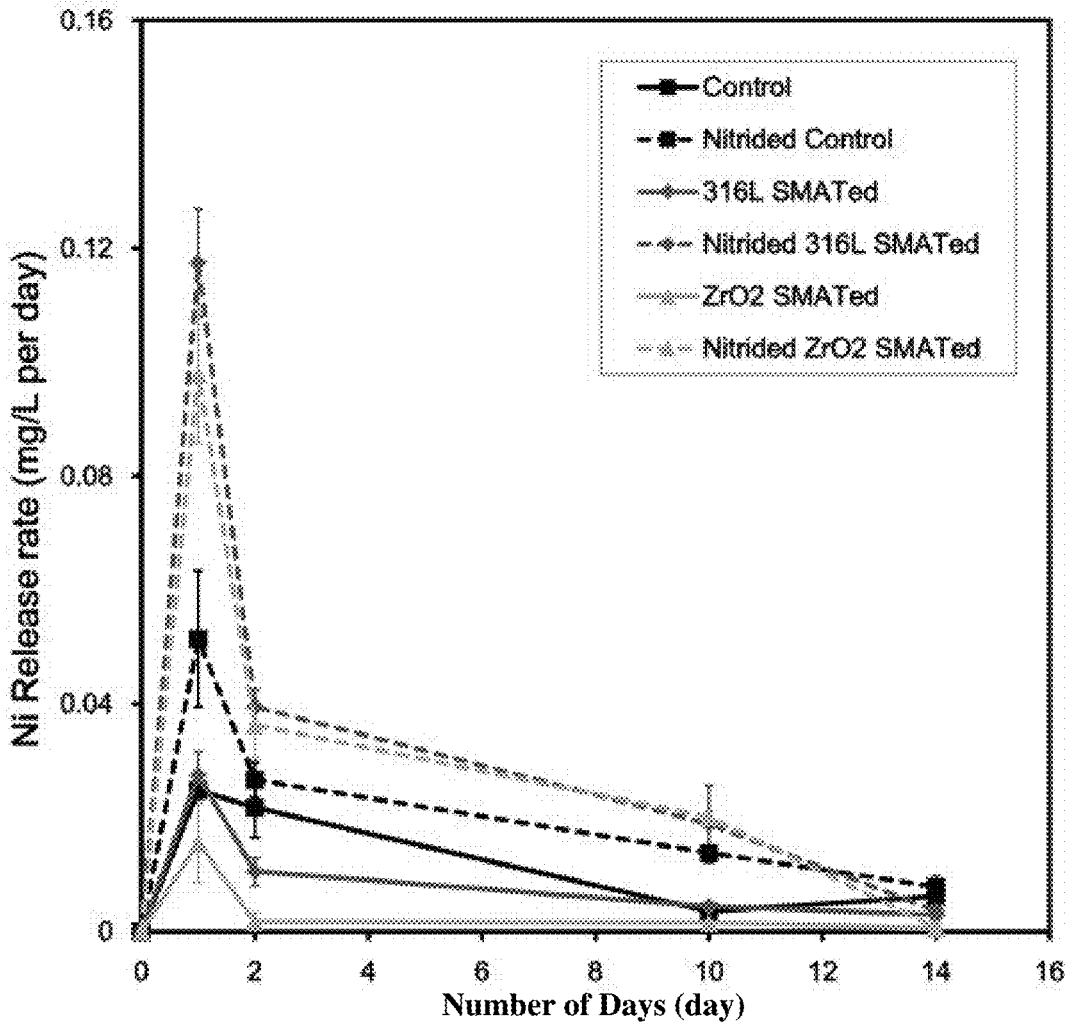
FIG. 23 shows Ni release rate of metal substrate samples treated by SMAT with different balls of the present invention and with/without treatment by plasma nitriding

To demonstrate negative effect of plasma nitriding on cytocompatibility of metal substrate (especially iron-containing alloy), amounts of Ni release of various samples (plasma nitriding treated sample versus non-plasma nitriding treated sample followed by SMAT process) are measured and the result is shown in FIG. 22. Regarding the plasma nitriding SMATed sample, the plasma nitriding is post-treated after the SMAT treatment. The result shows that all metal substrates (both control and SMATed samples) treated by plasma nitriding have relatively higher Ni release content than those without plasma nitriding treatment. Interestingly, among the three samples (control, 316L SMATed and $ZrO_2$ SMATed), $ZrO_2$ SMATed sample without plasma nitriding treatment has the most significant difference in Ni release content from the same sample treated by plasma nitriding. Similarly, as shown in FIG. 23, the nitrided $ZrO_2$ SMATed sample has the highest Ni release rate while the $ZrO_2$ SMATed sample has the lowest Ni release rate. In general, plasma nitriding can further improve the mechanical properties of metal substrate. However, from the above testing results, the cyto- and hemo-compatibity is significantly reduced by plasma nitriding due to the resultant large amount of toxic Ni release (iron nitride is not stable in humid environment). The high Ni release in samples treated by plasma nitriding, especially in the nitrided $ZrO_2$ SMATed sample, reveals that nitriding modifications are unfavorable to cytocompatibility of SMATed metal substrates, thereby not recommended in surface treatment of metal substrate of medical implant by using SMAT with the presently claimed balls. The foregoing description of the presently claimed invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

Disclosure of the following references are hereby incorporated by reference in their entirety:

REFERENCE

Chan, H. L., Ruan, H. H., Chen, A. Y., Lu, J., 2010. Optimization of strain-rate to achieve exceptional mechanical properties of 304 stainless steel using high speed ultrasonic SMAT. Acta Mater. 15, 5086-5096.

Chen, A. Y., Ruan, H. H., Wang, J., Chan, H. L., Wang, Q., Li, Q., Lu, J., 2011. The influence of strain rate on the microstructure transition of 304 stainless steel. Acta Mater. 59, 3697-3709.

Chen A Y, Ruan H H, Zhang J B, Liu X R, Lu J. Introducing a hierarchical structure for fabrication of a high performance steel. MATERIALS CHEMISTRY AND PHYSICS, 2011, 129:1096-1103.

Fang T H, Li W L, Tao N R, Lu K. Revealing Extraordinary Intrinsic Tensile Plasticity in Gradient Nano-Grained Copper. SCIENCE, 2011, 331: 1587-1590.

Fleck, N. A., Deshpande, V. S., Ashby, M. F., 2010. Micro-architectured materials: past, present and future. Proc. R. Soc. Lond. A. 466, 2495-2516.

Gibson, L. J., Ashby, M. F., 1997. Cellular Solids: Structure and Properties, second edition. Cambridge University Press.

Liu X C, Zhang H W, Lu K. Strain-Induced Ultrahard and Ultrastable Nanolaminated Structure in Nickel. SCIENCE, 2013, 342: 337-340Lu, K., Lu, J., 1999. Surface nanocrystallization (SNC) of metallic materials—presentation of the concept behind a new approach. J. Mater. Sci. Technol. 15, 193-197.

Lu, K., Lu, J., 2004. Nanostructured surface layer on metallic materials induced by surface mechanical attrition treatment. Mater. Sci. Eng. A. 375, 38-45.

Lu J., Lu K., 2010. Method for generating nanostructures and device for generating nanostructures. U.S. Pat. No. 7,691,211.

Lu J. et al., 2010. Method for improving metal surface diffusivity and application thereof. CN101899554A Roland T, Retraint D, Lu K, Lu J. Fatigue life improvement through surface nanostructuring of stainless steel by means of surface mechanical attrition treatment. SCRIPTA MATERIALIA, 2006, 54:1949-1954.

What is claimed is:

1. A method for treating a medical implant, the method comprising:

applying surface mechanical attrition treatment (SMAT) with a plurality of zirconium oxide ($ZrO_2$) balls on surfaces of a stainless steel based substrate of the medical implant; and providing an enclosure with a chamber for holding said substrate on one side of the chamber and a vibrating means on opposite side to said substrate;

wherein said vibrating means is configured to vibrate in a frequency and amplitude to move said plurality of $ZrO_2$ balls along the chambers towards said substrate such that the plurality of $ZrO_2$ balls being moved back and forth inside the chamber is capable of treating the surfaces of said stainless steel based substrate within a treatment scheme to improve cytocompatibility and hemocompatibility of the medical implant;

wherein treatment of said substrate by plasma nitriding is avoided; and wherein the treatment scheme comprises a total treatment time of about 30 minutes for treating two surfaces of the stainless steel based substrate, said total treatment time being divided into four time intervals comprising:

a. from 0 to $1^{st}$ minute: 5 seconds per strike on each surface of the substrate;

b. from $1^{st}$ to $5^{th}$ minute: 10 seconds per strike on each surface of the substrate;

c. from $5^{th}$ to $29^{th}$ minute: 15 seconds per strike on each surface of the substrate;

d. from $29^{th}$ to $30^{th}$ minute: 10 seconds per strike for 2 times on each surface followed by 5 seconds per strike for 2 times on each surface of the substrate.

2. The method of claim 1, wherein each of said plurality of $ZrO_2$ balls is in a diameter of about 3 mm.

3. The method of claim 1, wherein said stainless steel based substrate comprises a 316L stainless steel.

4. The method of claim 1, wherein said plurality of $ZrO_2$ balls is in total weight of 20 g when the stainless steel based substrate is in a dimension of 100 mm×50 mm×0.9 mm.

5. The method of claim 1, wherein said vibrating means is operated in a frequency at about 20,000 Hz.

6. The method of claim 1, wherein said vibrating means generates a working amplitude.

7. The method of claim 1, wherein the treatment time for treating each of the surfaces of the metal substrate is about 15 minutes.

8. A method for treating a stainless steel based substrate as a material of medical implant, the method comprising:

applying surface mechanical attrition treatment (SMAT) with a plurality of balls on surfaces of said substrate; and providing an enclosure with a chamber for holding said substrate on one side of the chamber and a vibrating means on opposite side to said substrate;

wherein said vibrating means is configured to vibrate in a frequency and amplitude to move said plurality of balls along the chambers towards said substrate such that the plurality of balls being moved back and forth inside the chamber is capable of treating the surfaces of said metal substrate within a treatment scheme;

wherein treatment of said substrate by plasma nitriding is avoided; and wherein the treatment scheme comprises a total treatment time of about 30 minutes for treating two surfaces of the metal substrate, said total treatment time being divided into four time intervals comprising:

a. from 0 to $1^{st}$ minute: 5 seconds per strike on each surface of the metal substrate;

b. from $1^{st}$ to $5^{th}$ minute: 10 seconds per strike on each surface of the metal substrate;

c. from $5^{th}$ to $29^{th}$ minute: 15 seconds per strike on each surface of the metal substrate;

d. from $29^{th}$ to $30^{th}$ minute: 10 seconds per strike for 2 times on each surface followed by 5 seconds per strike for 2 times on each surface of the metal substrate.

9. The method of claim 8, wherein said stainless steel based substrate comprises a 316L stainless steel.

10. The method of claim 8, wherein said plurality of balls is a plurality of zirconium oxide ($ZrO_2$) balls.

11. The method of claim 8, wherein each of said plurality of balls is in a diameter of about 3 mm.

12. The method of claim 8, wherein said plurality of balls is in total weight of 20 g when the stainless steel based substrate is in a dimension of 100 mm×50 mm×0.9 mm.

13. The method of claim 8, wherein said vibrating means vibrates at about 20,000 Hz.

14. The method of claim 8, wherein the treatment time for treating each of the two surfaces of the stainless steel based substrate is about 15 minutes.

* * * * *